US005582529A

United States Patent [19]

Montgomery

[11] Patent Number: 5,582,529

[45] Date of Patent: Dec. 10, 1996

[54] HIGH PERFORMANCE MOTORIZED WATER SKI

[76] Inventor: Robert E. Montgomery, 34478 Calle Carmelita, Dana Point, Calif. 92624

[21] Appl. No.: 393,171

[22] Filed: Mar. 1, 1995

Related U.S. Application Data

[63] Continuation-in-part of Ser. No. 205,277, Mar. 3, 1994, abandoned.

[51] Int. Cl.[6] ..... B63B 35/79

[52] U.S. Cl. ..... 441/74

[58] Field of Search ..... 441/65, 74, 79; 440/38, 46, 47; 114/270, 271, 56, 39.2, 362, 144 R

[56] References Cited

U.S. PATENT DOCUMENTS

| | | | |
|---|---|---|---|
| D. 276,994 | 1/1985 | Montgomery et al. | D12/307 |
| 1,945,435 | 1/1934 | Hopkins | 441/74 |
| 2,685,696 | 8/1954 | Oscanyan | 441/74 |
| 2,812,736 | 11/1957 | Fry | 114/124 |
| 3,262,413 | 7/1966 | Douglas et al. | 115/70 |
| 3,324,822 | 6/1967 | Carter | 115/70 |
| 3,369,518 | 2/1968 | Jacobson | 115/70 |
| 3,406,653 | 10/1968 | Mela | 115/70 |
| 3,463,116 | 8/1969 | Dawson | 115/70 |
| 3,481,303 | 12/1969 | Tate et al. | 115/70 |
| 3,548,778 | 12/1970 | von Smagala-Romanoff | 115/70 |
| 3,608,512 | 9/1971 | Thompson | 115/70 |
| 3,828,717 | 8/1974 | Nichols et al. | 115/6.1 |
| 3,882,815 | 5/1975 | Bennett | 115/70 |
| 3,911,846 | 10/1975 | England | 440/38 |
| 4,274,357 | 6/1981 | Dawson | 114/270 |
| 4,350,113 | 9/1982 | Moreau et al. | 114/270 |
| 4,402,674 | 9/1983 | Roberts | 440/46 |
| 4,538,996 | 9/1985 | Inwood | 440/38 |
| 4,628,852 | 12/1986 | Nishida et al. | 114/270 |
| 4,857,025 | 8/1989 | Brown et al. | 441/74 |
| 5,167,550 | 12/1992 | Nielson | 114/270 |
| 5,385,494 | 1/1995 | Wilhelmi | 441/74 |

FOREIGN PATENT DOCUMENTS

| | | | |
|---|---|---|---|
| 575130 | 12/1993 | European Pat. Off. | 114/39 |
| 2617793 | 1/1989 | France | 114/270 |

OTHER PUBLICATIONS

Pp. 3/80 & 3/81 of Marine Technology Reference Book 1990.

*Primary Examiner*—Ed Swinehart
*Attorney, Agent, or Firm*—Lynn & Lynn

[57] ABSTRACT

A high speed motorized water ski (10) has a hull (16) having a bow (18), a stern (20) and a deck (22) sized for accommodating a standing rider (12). A jet pump (100) is mounted in the stern (18) for discharging a propelling stream of water outwardly from the stern (18) in a direction generally parallel to a longitudinal axis (144) of the hull (16). A motor (108) is mounted within the hull (16) for driving the jet pump (100). The standing rider controls the speed of the motorized water ski (10) by means of an arm pole (26) having one end attached to the hull (16) near the bow (18). A hand grip (132) is attached to the other end of the arm pole (26) for enabling the standing rider to control motor speed and for providing stabilization to the standing rider's stance on the deck (22). The motor (108), jet pump (100) and other components of the motorized water ski (10) are mounted in the hull (16) to define a center of gravity so that when a rider of average weight stands on the deck (22), the composite center of gravity (120) of the motorized water ski (10) and rider (12) is beneath the deck (22) in order to enable the standing rider (12) to turn the motorized water (10) ski solely by a shift in rider stance on the deck (22).

4 Claims, 17 Drawing Sheets

HIGH PERFORMANCE MOTORIZED WATER SKI

CROSS REFERENCE TO RELATED APPLICATION

This is a continuation-in-part of U.S. patent application 08/205,277 which was filed Mar. 3, 1994, now abandoned.

BACKGROUND OF THE INVENTION

The present invention introduces a new category of motorized personal water craft: a high speed, high thrust, high performance craft with no steering mechanism for turning. The present invention is a stable, maneuverable, high speed motorized water ski suitable for use by a single rider standing on a rear deck. The rider may turn the water craft according to the present invention solely through his body position, stance and weight distribution. Exceptional speed, maneuverability and rider/craft stability are achieved by a unique and precisely calculated combination of several design parameters including, thrust, speed, weight, engine power, buoyancy, placement of mechanical components to provide a precisely located center of gravity, bottom hull/rail configuration and hull structure.

Prior art motorized personal water craft include: (a) high powered, high speed craft with swivel jet steering mechanisms (devices) for turning; (b) low speed, low performance craft with rudders and other steering mechanisms for turning; and (c) low speed, low performance craft with no steering mechanism for turning.

Many high powered motorized personal water craft that have previously been available use movable jet nozzles or other mechanisms for turning the craft. Such water craft may support either a seated or standing rider. The engine position and cockpit structure of previous motorized aquatic vehicles cause the net center of gravity of the craft plus rider to be substantially in front of the rider while making a turn. All steering devices such as directional nozzles and rudders cause the pivot point to be far in front of the rider, which causes instability. This location of the net center of gravity causes the pivot point for making turns to also be substantially in front of the rider. The forward net center of gravity renders these craft unsuitable for high speed or high performance use by a standing rear mounted rider. In particular, the forward center of gravity causes rider instability. With such craft it is impossible to make high speed turns solely under the control of the rider's stance and weight distribution.

In addition to the very high and forward net center of gravity and extreme forward pivot point of heretofore available stand-up and sit-down high powered personal water craft, these craft also have high, slightly curved, vertical side rails. Consequently, if the rider leans to the side without using a directional nozzle to turn the craft in a direction opposite to the direction he is leaning, the rider typically loses his balance and takes an unexpected plunge into the water.

The inertia of the rider's body causes the rider to tend to travel in a straight line. As the prior art craft starts to turn, the rider feels it move laterally under him as he continues to tend to move in a straight line. Therefore, in executing turns with such personal water craft, the standing rider's body moves from side to side relative to the craft. Sudden turns can cause the rider to lose his sense of balance.

A movable pump nozzle is used to turn one type of prior art jet-driven standup water craft (commonly referred to as a Jet Ski). The nozzle is directed away from the longitudinal axis in a plane generally parallel to the water. The nozzle then causes a torque or moment about a vertical axis through the net center of gravity of the craft and rider. In operation, if water is propelled to port, the stern of the craft rotates to starboard while the bow turns to port. This movement of the bow and stern is due to the fact that the craft will pivot about its net center of gravity, which is located far forward of the rider.

Therefore, when the rear mounted rider of this type of personal water craft turns the pump nozzle, the craft rotates about the forward center of gravity. The rider's body moves from side to side, which causes a sensory loss of balance or stability. This is a serious stability problem that is addressed by the prior art by increasing the size and weight of the craft in order to achieve acceptable stability for the rider. This also is the reason for the popularity of sit-down craft, which typically use a directional nozzle for turning. The directional nozzle turns left or right and causes the tail to slide in the opposite direction. Because the rider is sitting, he is better able to accommodate instability during turns.

It also must be appreciated that in today's market, a personal water craft is expected to attain speeds of between 30 and 55 miles per hour (approximately 50 to 88 km/hr). A desirable feature of high performance personal water craft is the capability of turning and maneuvering the craft solely by movement of the rider's body. Currently available high speed personal motorized water craft do not provide the capability of being controlled by rider stance and weight distribution. Rather, the body movement associated with the rider of the present day water craft is only in reaction to the directional thrust of a water jet or other turning mechanism in order to maintain stability to prevent the rear mounted rider from being thrown from the craft during maneuvers.

Previous attempts to provide a motorized personal water craft for a standing rider using mechanisms other than swivel jets for turning have been necessarily low speed, low thrust, low performance craft. Some such craft use rudders for steering. These craft do not utilize the relationship of the location of the rider to the location of the center of gravity for negotiating stable turns.

U.S. Pat. No. 3,548,778 to Von Smagala-Romanov discloses a self-propelled surfboard having a propeller that is driven by an internal combustion engine. The propeller is located in a recess in the bottom of the board. The propeller blade is housed within a shield to prevent the blade from contacting a swimmer or the rider if he should fall off the board. The internal combustion engine is mounted within a cavity located centrally of the front and rear ends of the board. The driving propeller is mounted closely behind the engine so as to be generally under the deck portion where a rider would stand.

Von Smagala-Romanov discloses a low power, low speed craft that cannot be made to turn without the use of a rudder, movable jet or other mechanical steering apparatus. Von Smagala-Romanov discloses that his device could be made steerable by incorporating an optional mechanized fin using appropriate cables controlled by rider. By indicating that the craft can be made steerable by using a rudder, movable jet, mechanized fin or other mechanical steering apparatus; Von Smagala-Romanov shows that he did not consider the location of the center of gravity as being a factor in turning. It is evident from the disclosure of Von Smagala-Romanov that the location of the net center of gravity of the craft and rider has nothing to do with the steering or maneuvering of the Von Smagala-Romanov craft. Furthermore, careful study of the Von Smagala-Romanov device indicates that it is a low buoyancy craft that would support only a light-weight rider.

At best, Von Smagala-Romanov is necessarily a low power, low speed craft incapable of a speed anywhere near 30 miles per hour. Careful study of the Von Smagala-Romanov device further indicates that it would accommodate only a small engine of about 4 to 5 HP. The small engine would provide insufficient thrust to produce short radius turns. The hull structure of Von Smagala-Romanov is suitable only for low speeds of less than about 8 miles per hour. Any greater speed would raise a safety issue. The drive mechanism (propeller) in the Von Smagala-Romanov craft is located under the rider, exterior to the hull and forward of the stabilizing fin. This underwater location of the drive mechanism would not be efficient or suitable for placement of a high-thrust jet flow pump.

Von Smagala-Romanov does not take into account the critical placement of mechanical components in relationship to the position of its rider in order to achieve acceptable performance even at low speed. In the position of the rider relative to the position of the lower weight mechanical components shown, the rider's weight would dominate. The bow would be raised significantly out of the water, thus producing unacceptable resistance to forward motion. This type of resistance to forward motion is sometimes referred to as the "ploughing effect." If the rider were to move forward to level the craft, assuming there enough flotation for such movement, he would be inconveniently standing where the vent tube and hand control are located.

French patent 2,617,793 to Trotet discloses a motorized nautical board. Trotet uses a low center of gravity that is below the water line to stabilize the board against overturning. However, like the Von Smagala-Romanov craft, the location of the center of gravity in Trotet has absolutely nothing to do with the turning or maneuvering of the craft. Trotet, like Von Smagala-Romanov, teaches the steering and maneuvering of the craft using a moveable rudder or steering mechanism. In the Trotet craft the net center of gravity is forward of the rider so that during a turn, the stern slides to the left or fight, depending on the direction of the turn, which thereby destabilizes the standing rider.

Trotet, with an 80 cc engine capable of no more than 5 to 8 miles per hour and 50 pounds of thrust, teaches a low speed leisure craft rather than a high speed performance craft. The rider of the low speed board of Trotet would be unstable during takeoff while standing on the rear deck. The Trotet board has insufficient thrust for safely making short radius turns even at low speeds because of its forward pivot point and large vertical profile keel, which causes increased water resistance during turns. Replacing the small engine of Trotet with a larger engine, even if the hull were redesigned to accommodate it, would not enable the Trotet craft to have high speed performance features.

The prior art also discloses motorized water craft with no mechanical turning device. None of these craft are capable of high speed controlled turns or responsive, small radius, low speed turns.

U.S. Pat. No. 3,608,512 to Thompson discloses a boat hull that is provided with its own propulsion unit and that accommodates a standing rider. Thompson discloses a substantially flat-bottomed hull filled with buoyant material and having an upwardly open, longitudinally extending compartment that is open rearwardly at the stern of the hull for accommodating an operator in a standing position. A pair of elongate, longitudinally extending singly formed, narrow fins extend laterally of the compartment. The flat bottom surface merges arcuately into the inner faces of the fins and is preferably provided with elongate, longitudinally extending grooves intermediate the fins. A shrouded propeller, jet orifice, or other suitable arrangement is positioned at the stern directly below the open rear end of the compartment and between the fins. A well in the hull near the bow in front of the compartment serves to receive an internal combustion engine. The large bow mounted engine places the net craft plus rear mounted standing rider such that the pivot point on turns would be far in front of the rider, which destabilizes him as described previously. Therefore, this relatively bulky craft would not be capable of executing responsive, stable high speed turns or safe, short radius low speed turns and maneuvers.

U.S. Pat. No. 3,406,653 to Mela discloses a four foot long, nine pound powered float board which cannot accommodate a standing rider. The engine is relatively openly exposed to water and has no bilge pump. The Mela device is capable speeds of only a few miles per hour. Having no sealed engine housing and no bilge pump renders the disclosed device unsuitable for high performance use. The float board has no rails that would permit it to make high-speed turns.

One particular type of motorized personal water craft is sold under the name Surf Jet. The Surf Jet motorized water craft has a top speed of about 22 miles per hour. The Surf Jet has a rear-mounted engine in a compartment that extends a considerable distance above the water line. The heavy, stern mounted engine causes the stern of this craft to sit very low in the water unless the rider stands a considerable distance in front of the engine. The center of gravity of this craft is located within about 20% of the total craft length measured from the stern. The rider is forced to stand at or forward of the craft midlength in order to balance the heavy stern mounted engine and centrifugal pump and to avoid the large vertical protrusion of the engine housing. Because of this protrusion, which is about 1.5 feet above the deck, the rider is inconveniently forced to mount the craft from the side while in the water. The Surf Jet utilizes a maximum 17 HP vertical mounted engine, vertical drive shaft and an inefficient (relative to an axial flow pump) centrifugal jet pump that produces a maximum thrust of about 130 pounds. It is obvious that the center of gravity was not considered in balancing this craft. Increasing the size of the engine and pump to achieve more thrust and performance would be impractical because this would further deteriorate the balance and stability of the craft. Therefore, the Surf Jet design is essentially a low performance craft because the engine must be small in order to keep the rider from having to stand near the bow of the craft to balance it and keep the bow from being too high above the water line. If the net center of gravity is too close to the stem, then at moderate speeds, the bow begins to lift, which causes instability and the ploughing effect.

For many water sports enthusiasts, personal enjoyment from the operation of a powered water craft will be significantly increased if the rider can, at both low and high speed, turn and control the craft solely by rider stance and weight distribution without the use of active steering mechanisms. Such enjoyment is presently not achieved with motorized water craft as it is at lower speeds with non-motorized craft, such as surfboards and body boards, where personal fulfillment is accomplished through the successful and skillful control of the rider's body for manipulating the board.

SUMMARY OF THE INVENTION

It is an object of the present invention to provide a high performance watercraft that enables a rear mounted standing rider to experience high speeds in excess of 30 miles per hour (approximately 50 km/hr), and the capability to maneuver into high speed, high peak g-force (3 to 6 times gravity) controlled and stable turns and low speed turns using only a slight shift of the rider's weight or position on the craft in conjunction with proper application of thrust. No variable-direction jet or other steering mechanism is required. Exceptional speed, maneuverability and rider/craft stability are achieved by a unique and precisely calculated combination of several design parameters including, thrust, speed, weight, engine power, buoyancy, placement of mechanical components (center of gravity), bottom hull/rail configuration and hull structure. Achieving the necessary balance and leverage by precise and unique design of the relationship between the craft center of gravity and the craft plus rider (or net center of gravity) is critical to both the demonstrated performance and maneuverability of the craft.

The design of the craft enables a rear mounted standing rider to initiate and complete stable high speed coordinated turns by slight shifts in the rider's weight and/or position on the deck, using no other turning mechanism. The direction of thrust is maintained parallel to the longitudinal axis to the craft center line at all times. In the prior art, craft with rear mounted riders are turned by movement of a rudder or by changing a water jet propulsion vector at an angle to the craft longitudinal centerline. This produces an induced horizontal moment or side load that abruptly slides the stern of the craft left or right, placing the craft pivot point far in front of the rider. The craft spins abruptly around this pivot point and destabilizes the rider. In the present invention, the vertical pivot point and the net center of gravity are maintained essentially underneath the rider throughout a turn as the craft longitudinal centerline remains approximately tangent to a uniform arc defining the turn. The water jet thrust vector remains parallel to the longitudinal axis of the craft throughout the turn. The stern does not slip left or right.

A high speed motorized water ski in accordance with the present invention generally includes a hull, having a bow, a stern and a deck portion sized for accommodating a standing rider. An axial flow jet pump is fixedly mounted in the stern. A motor is disposed within the hull for driving the jet pump. The jet pump and motor provide for discharging a propelling stream of water outwardly from the stern in a single fixed direction relative to the craft. The direction of the propelling stream of water is generally parallel to the longitudinal axis of the motorized water ski.

A standing rider can control the speed of the craft by means of controls mounted to an arm pole having one end attached to the hull proximate the bow. A universal left or right hand grip is attached to the other end of the arm pole. The arm pole and hand grip with thumb-activated motor control apparatus allow the standing rider to control motor speed, lift the bow and stabilize his stance on the deck.

The motor, battery, fuel tank, jet pump and other components of the motorized water ski according to the present invention are mounted in the hull so that the center of gravity of the motorized water ski is beneath the deck portion. The center of gravity of the riderless craft according to the present invention is in a defined envelope of distance along the length of the craft. The location of the center of gravity of the riderless, empty craft is selected to enable the standing rider to turn the motorized water ski solely by a shift in his stance or weight distribution on the deck portion.

More specifically, the center of gravity is disposed on a vertical plane through the craft longitudinal axis behind the beam of the hull. Preferably the craft center of gravity is more than 50 percent of the length of the motorized water ski from the bow and more than 25 percent of the motorized water ski length from the stern.

In this arrangement, the engine is forward of the net craft center of gravity and the pivoting point during turns, which is beneath the deck portion where the rider stands. It is possible therefore for the rider to stand in a neutral position where the net center of gravity of the craft and rider moves to a "sweet spot" position generally in the region of the rider between his front and back feet. Consequently, any shift of the rider's body weight distribution away from the neutral position is effective in responsively turning the motorized water ski while underway.

The engine and jet pump are sized for propelling the motorized water ski at speeds exceeding about 30 miles per hour (approximately 50 km/hr). Fins that may be either fixed or retractable are fastened on the hull bottom for stabilizing the motorized ski during turns and maneuvers. If the fins are retractable, the rider may use the motorized water ski for ramp jumping. In this instance, the retractable fins are mounted for retraction into the hull by vertical impact of the fins on the ramp.

A generally flat hydroplane surface with a variable height hydrostep is formed on the bottom of the hull, directly beneath the deck portion, beginning at a point approximately in front of the pump water intake grate and proceeding aft to the stern. At high speed, the motorized water ski in accordance with the present invention planes on the hydroplane surface, thereby reducing fluid drag and causing the motorized water ski to be still more responsive to the rider's stance for effecting sharp turns at speeds of 30 miles per hour (approximately 50 km/hr) or more.

Further, the motorized water ski in accordance with the present invention includes curved side rails for further enabling, in combination with the hydroplane surface and defined center of gravity, the maneuverability of the craft solely by movement of the rider's body.

The motorized water ski in accordance with the present invention includes a flat profile of the hull at the stern and deck portions for enabling a rider easily to board the motorized water ski from the stern while in a horizontal position in the water body.

There is no other motorized water craft that enables high speed, stable, rider-controlled turns based on speed, thrust, weight, bottom hull-side rail design and a balanced central placement of fuel and mechanical components such as engine, battery, fuel and exhaust. No mechanical steering device is used in the present invention. The present invention is a personal water craft that out-performs previous devices for stand-up riders in low and high speed turns by giving the rider more stability than all personal water craft that have a directional axial flow jet drive pump or other steering mechanism. The present invention has no mechanically operated swivel jet drive directional nozzle or other steering mechanism. The advantages of the present invention are achieved by a precisely located craft center of gravity; a unique bottom hull-rail design and by proper balance of weight and thrust for stability and performance. The present invention has a craft center of gravity that is within a selected portion of the hull to provide stability and maneuverability at all speeds.

Placement of the center of gravity is a primary factor in defining the configuration of the watercraft. Placement of the components that form the major weight of the craft (the engine, the jet pump the rider within typical adult weight ranges, and the internal bulkheads of the shaped compartment) are the major determinants of center of gravity.

However, the center of gravity may also be adjusted and tuned to conform to the requirements of this invention by adding ballast weights at various points on or in the hull of the craft, or by shaving the material of the hull to reduce weight at selected points.

The contribution to the art of this invention is a watercraft whose placement of center of gravity is the focus of invention and which enables its superior performance. Specifically, the net center of gravity must be placed to remain aft of the longitudinal midpoint and between the side rails at all significant operational speeds, conditions, rider weight shift and longitudinal travel.

It will be appreciated that while center-of-gravity calculation and placement is essential to the spirit of the invention, other specified components may be interchanged with equivalent functional components, and that further developments, substitutions, or improvements may replace or supplement the specified components without departing from the inventive concept. For example, the gasoline motor disclosed as the motive power of the craft may be equivalently replaced by an electric motor and battery or a combustion motor powered by different fuel. Similarly, a shielded screw drive or an equivalent drive unit may be substituted for the jet pump.

Placement of the center of gravity is an incidental element in the prior art and not essential to any purposes or functions of the prior art devices. The objective of much of the prior art has been to enable personal watercraft propulsion in a basic and slow speed form without regard to operation in a wide range of conditions, including very high speeds. As sports equipment design in various environments has advanced, so the demands for a more capable, higher speed, stabilized, personal watercraft have advanced. In particular, the benefits and sporting challenges of side-stance personal high speed vehicles have become much more popular, as witness the explosion of interest in skate boarding and snowboarding spin-offs of the venerable sport of surfboarding. All these sports and associated equipment recognize the superior balance and control that can be achieved by a skilled rider in a side facing stance that enables rapid yet stable weight shifts as the exclusive controlling and steering function. Thus an objective of the invention is to provide a high speed watercraft that is operated in the same side-stance manner as other side-stance sports equipment that use weight shift as the sole means of turning and controlling direction of the craft.

An appreciation of the objectives of the present invention and a more complete understanding of its structure and method of operation may be had by studying the following description of the preferred embodiment and by referring to the accompanying drawings.

DESCRIPTION OF THE PREFERRED EMBODIMENT

Structure of the Motorized Water Ski

Figure 1A:
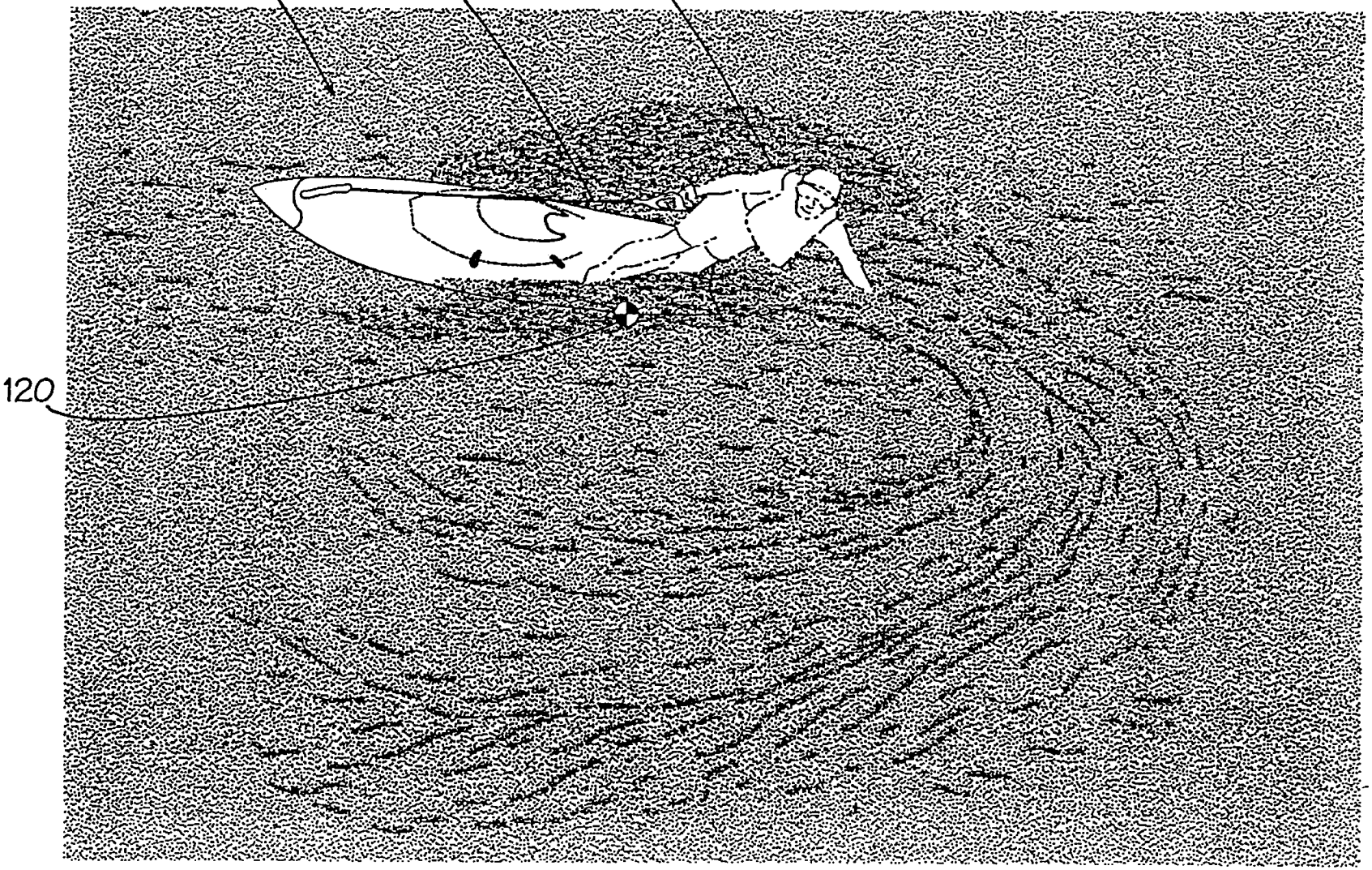
FIG. 1*a* is a perspective view of the motorized water ski in accordance with the present invention as it is manipulated through a controlled high speed, high g-force turn.
Figure 1B:
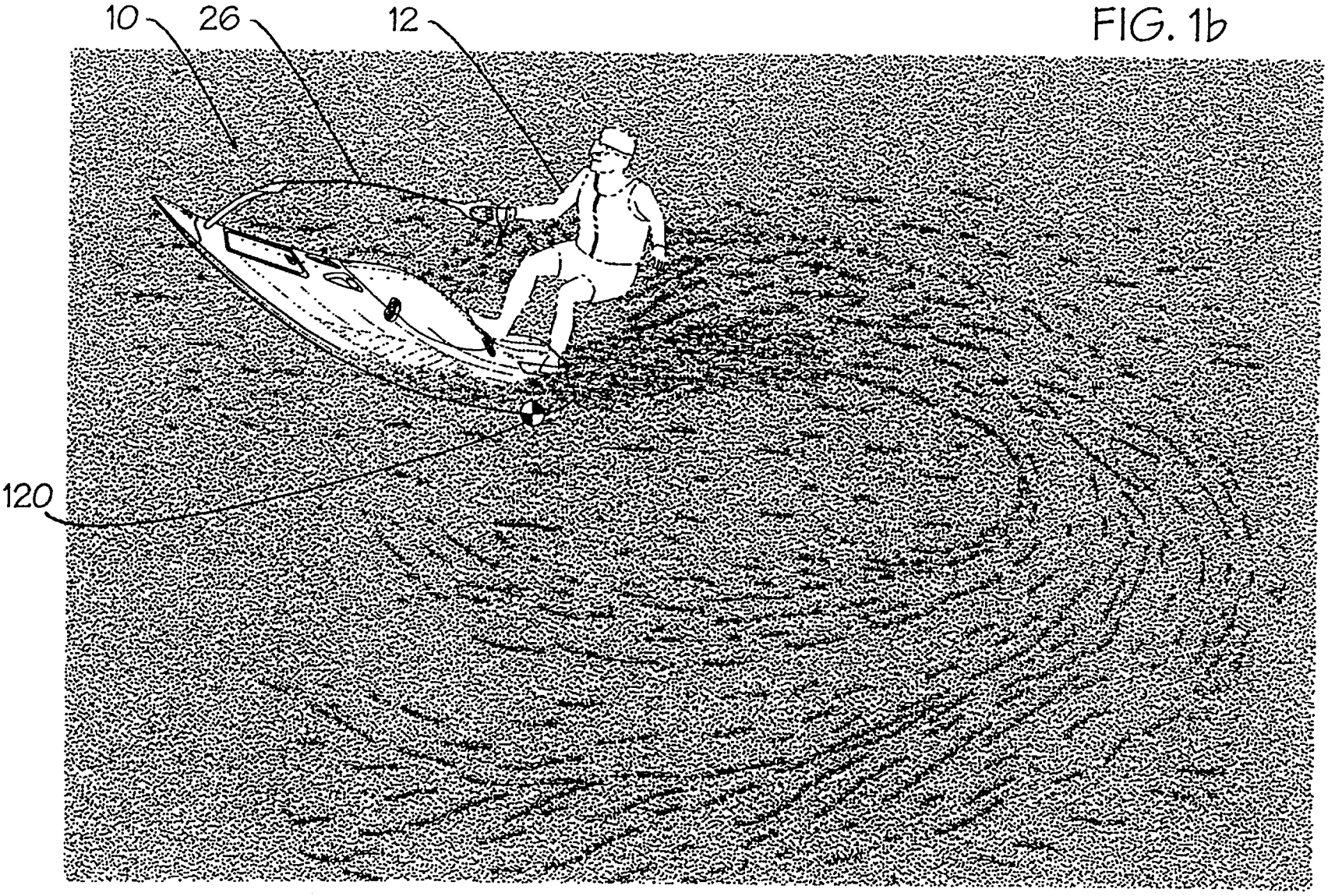
FIG. 1*b* is a perspective view of the motorized water ski in accordance with the present invention as it is manipulated through a lower speed, short radius, high thrust turn.
Figure 1C:
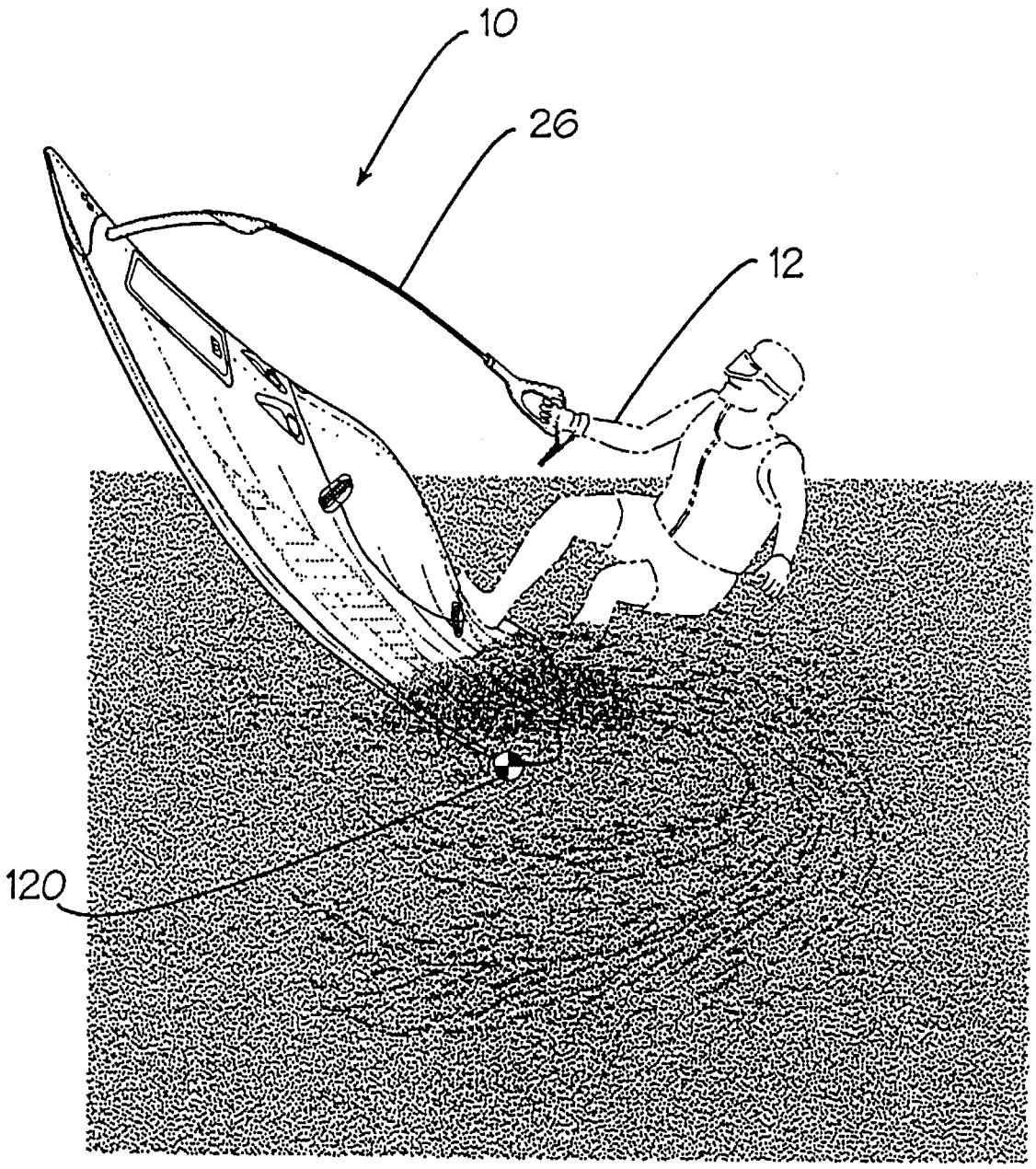
FIG. 1*c* is a perspective view of the motorized water ski in accordance with the present invention as it is manipulated through a vertical spin turn maneuver.

Referring to FIGS. 1*a*–1*c*, there is shown a high speed motorized water ski 10 according to the present invention as it may be used by a rear mounted standing rider 12. FIG. 1*a* is a perspective view of the motorized water ski 10 as it is manipulated through a controlled high speed, high g-force turn at speeds of 30 miles per hour (approximately 50 km/hr) or more. FIG. 1*b* is a perspective view of the motorized water ski 10 as it is manipulated through a lower speed, short radius, high thrust turn. FIG. 1*c* is a perspective view of the motorized water ski 10 as it is manipulated through a vertical spin turn maneuver. This turning of the high speed motorized water ski 10 as shown in FIGS. 1*a*–1*c* is initiated and controlled solely by the stance and weight distribution of the rider 12 upon the water ski 10 and application of thrust as described in detail subsequently. No prior art personal water craft that does not have a steering mechanism is capable of these turns and maneuvers with a standing rider.

Figure 1D:
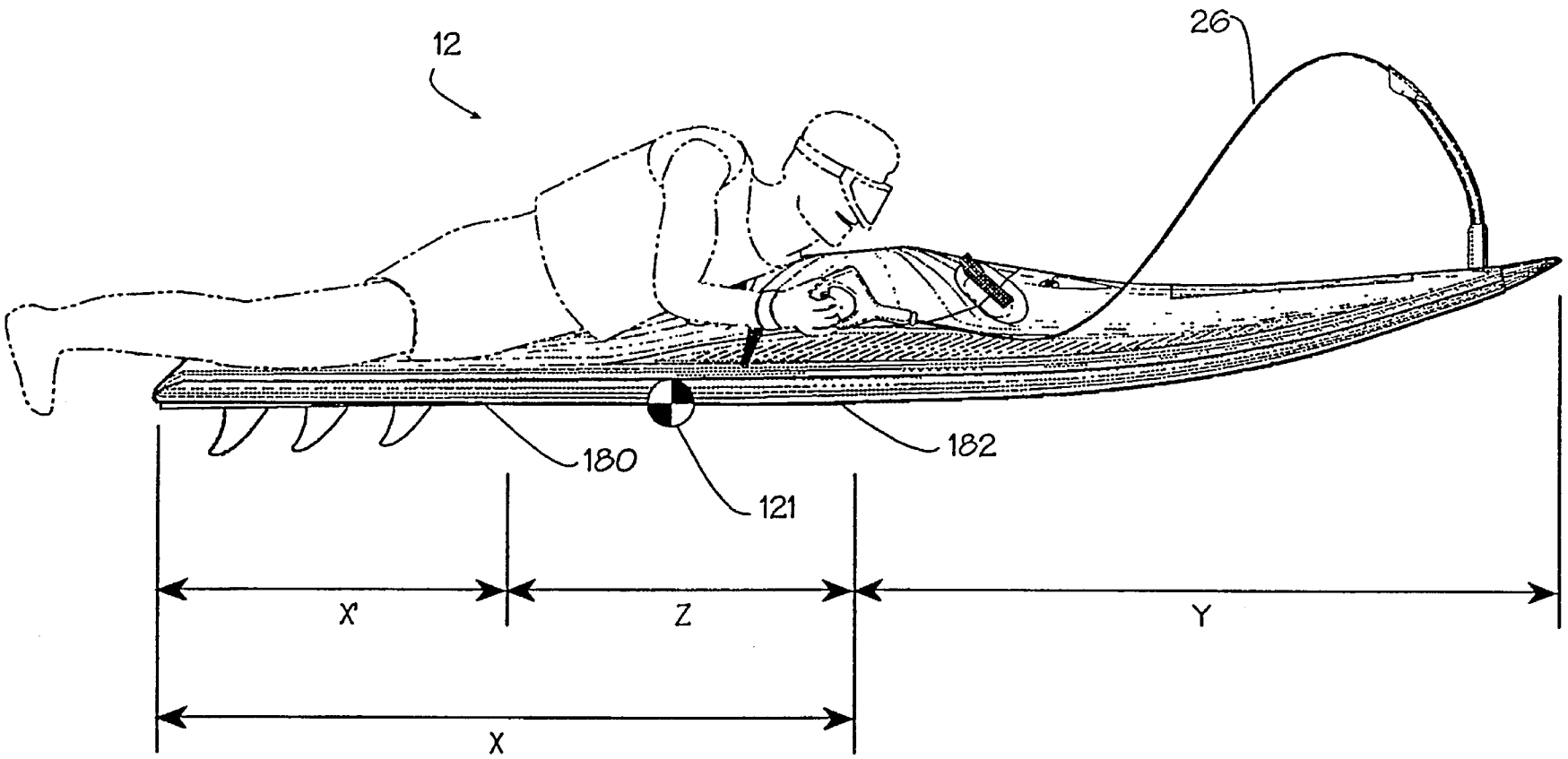
FIG. 1*d* represent a rider in the water mounting the motorized water ski according to the present invention from the rear.
Figure 2:
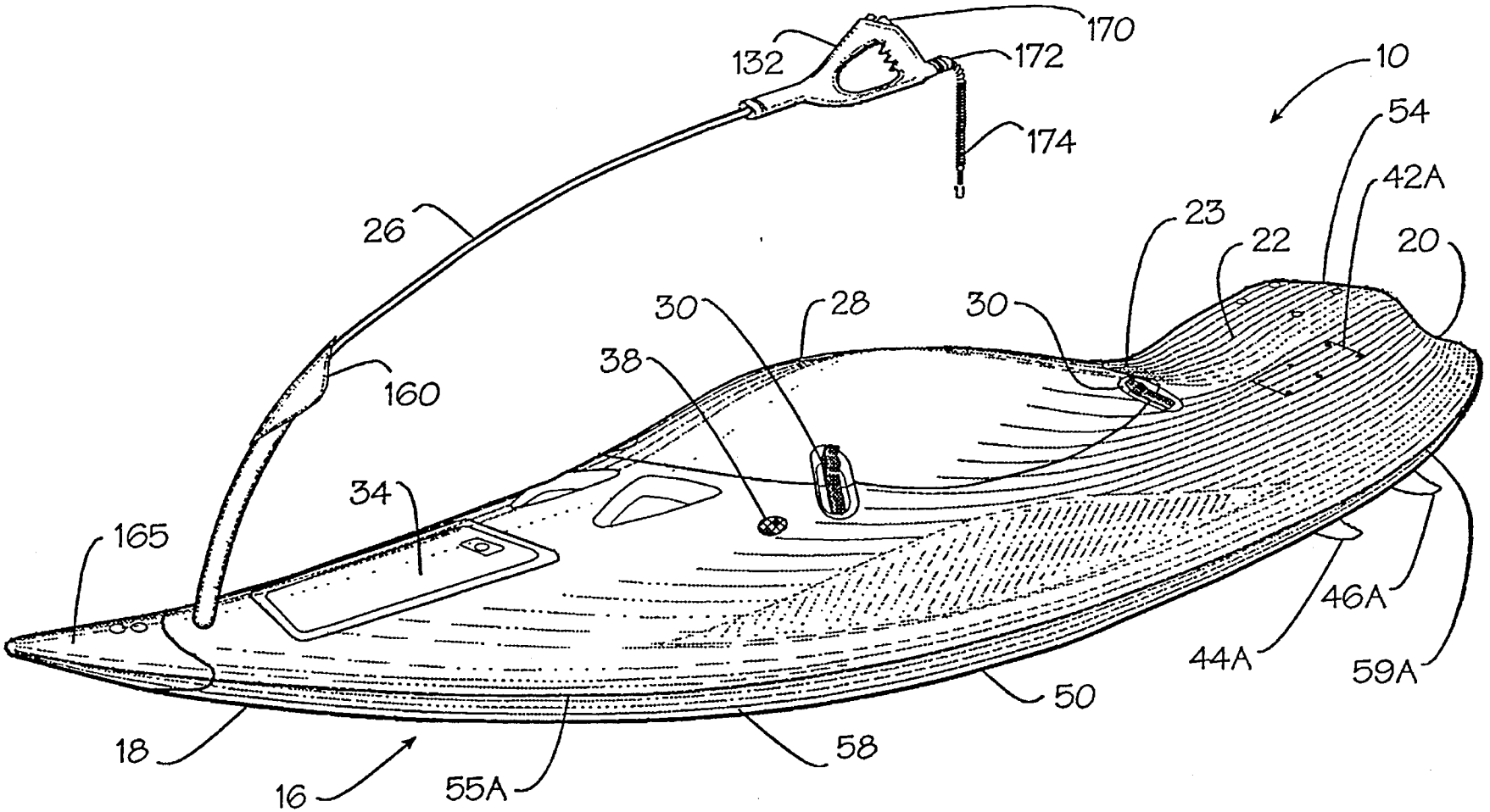
FIG. 2 is a perspective view of the motorized water ski in accordance with the present invention generally showing a hull having a bow, a stern, a deck portion and an arm pole.
Figure 16:
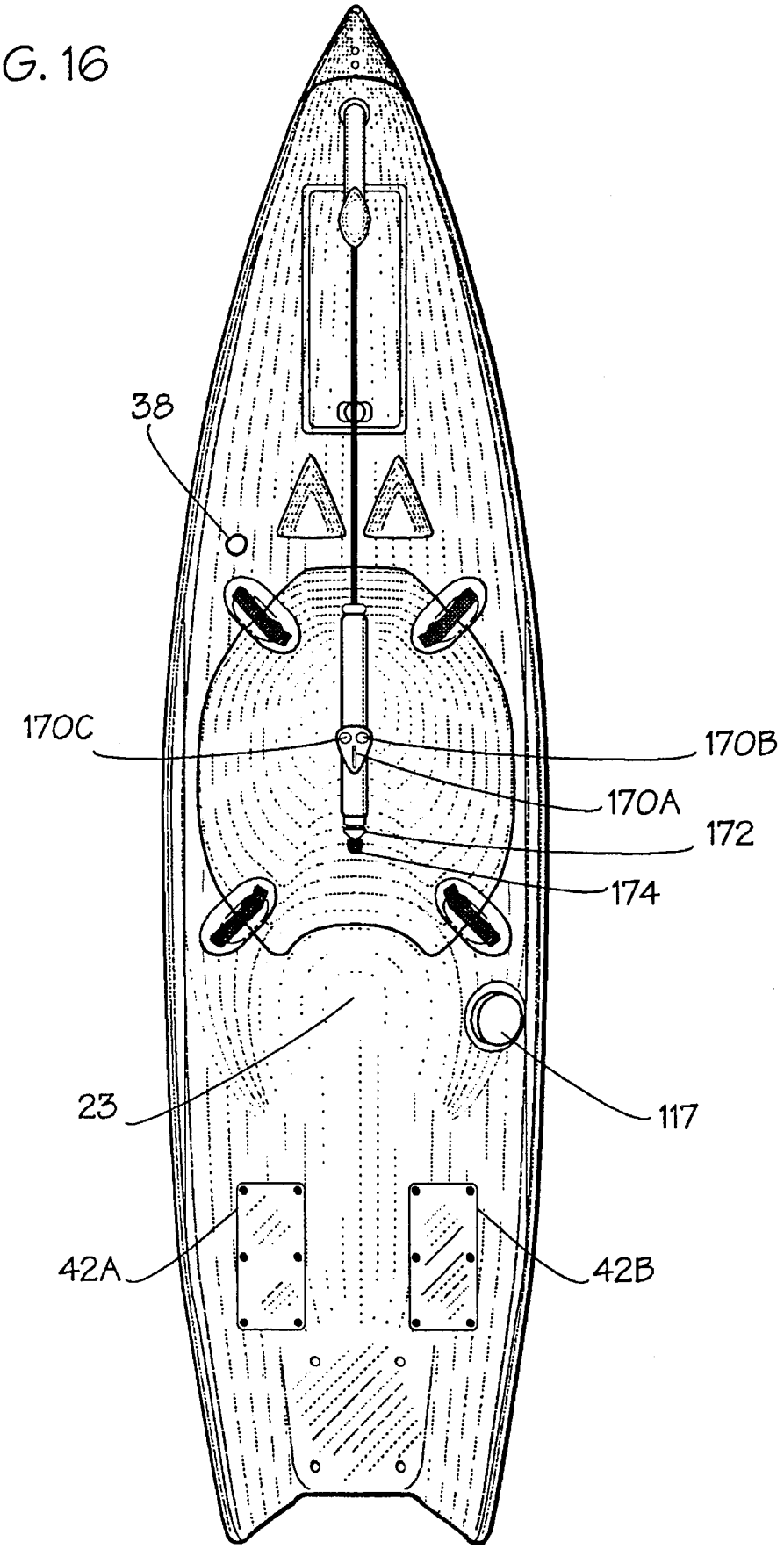
FIG. 16 is a top plan view of a motorized water ski according to the present invention showing details of the arm pole assembly and controls.

Referring to FIGS. 1*a*–1*c*, 2, 14 and 16, the motorized water ski 10 generally includes a hull 16 that has a bow 18, a stern 20 and a rear deck portion 22. The rear deck portion 22 is sized for accommodating a standing rider as shown in FIGS. 1*a*–1*c* and 14. The deck portion 22 has also been designed to accommodate a prone rider 12, shown in FIG. 1D, who is able to easily mount the ski in deep water from the stern. The capability of the rider 12 to mount the motorized water ski 10 from the stern 20 is a significant advantage over the Surf Jet. Mounting the motorized water ski 10 from the rear decreases the likelihood that it will turn over during the mounting process. The prior art rear mounted engine motorized surf board known commercially as the "Surf Jet" cannot be mounted from the stern because of the vertical protrusion of the motor housing. A chest cavity depression 23, shown in FIG. 16, is preferably molded in the deck 22, to improve the comfort of the rider 10 as he operates the craft in a prone position.

Also shown in FIGS. 1*a*–1*c* and 13–16 is a flexible arm pole 26, described hereinafter in greater detail, along with an engine compartment hood 28, hood latches 30, a fire extinguisher compartment cover 34, a master power switch 36, a bilge pump outlet 38, access covers 42A and 42B and fins 44A, 44B, 46A and 46B. The fins 44A, 44B, 46A and 46B may be either fixed or retractable upon impact and may vary in horizontal and vertical dimension.

The hull 16 is preferably made from molds (not shown) suitable for fiberglass molding using appropriate resins. Such molds and techniques for fiberglass molding are well-known and are therefore not described herein. Referring to FIGS. 2–9, the hull 16 includes a bottom shell 50, a top shell 52 and a top deck 54. The bottom shell 50, the top shell 52 and the top deck 54 are all bonded to one another with a suitable bonding agent to form a monolithic structure when the hull 16 is fully assembled.

Figure 3:
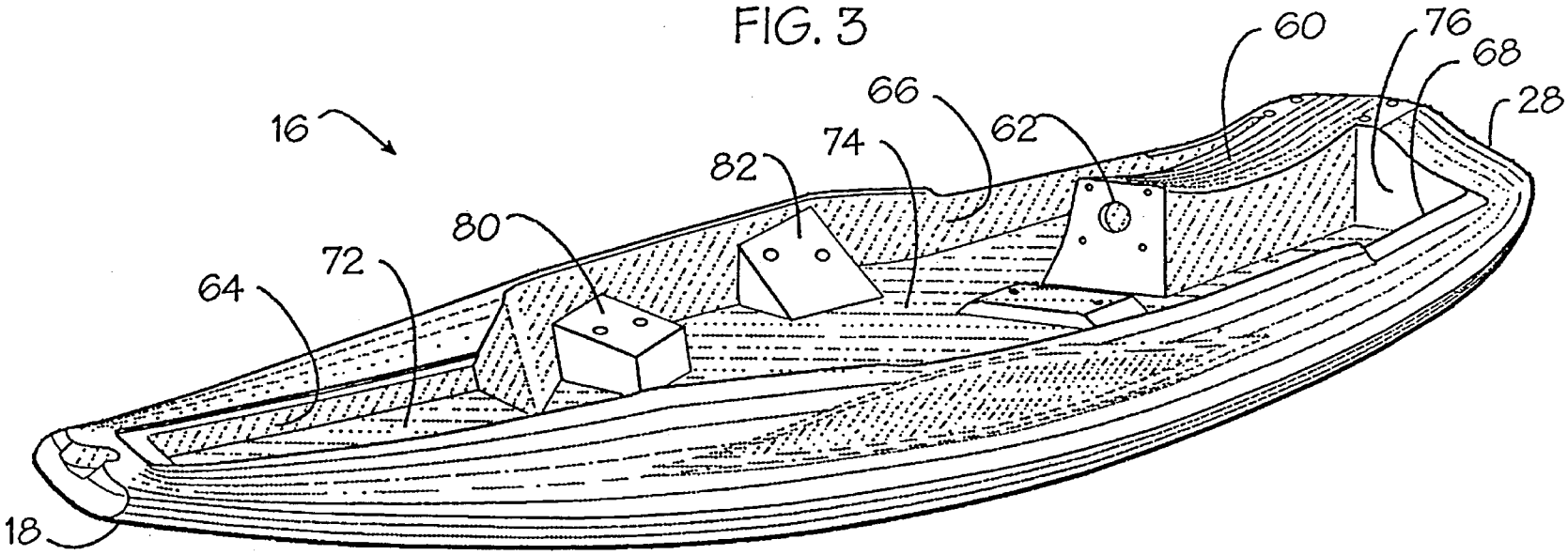
FIG. 3 is a perspective view of the bottom portion of the hull generally showing interior vertical walls for support and engine pod mounts.
Figure 4:
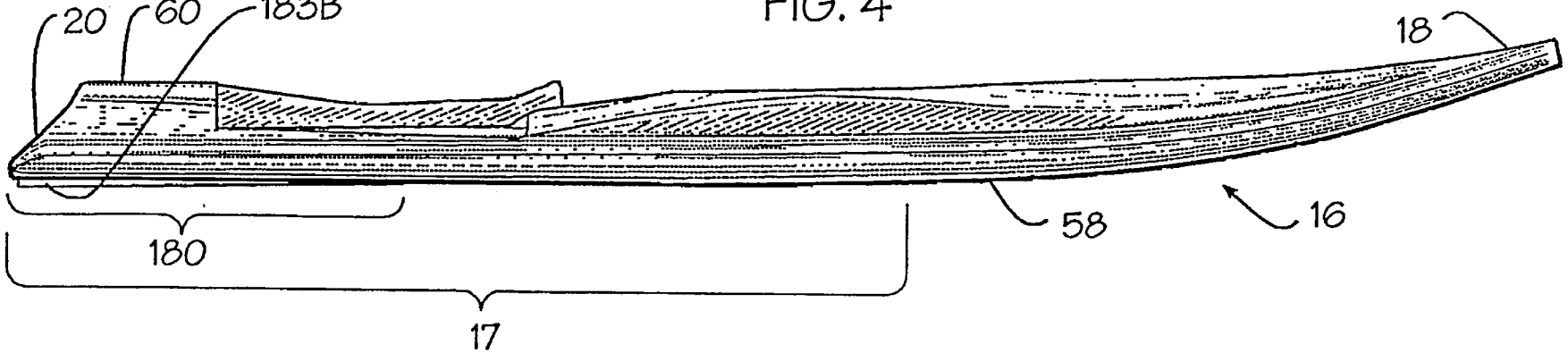
FIG. 4 is a side view of the hull bottom.
Figure 5:
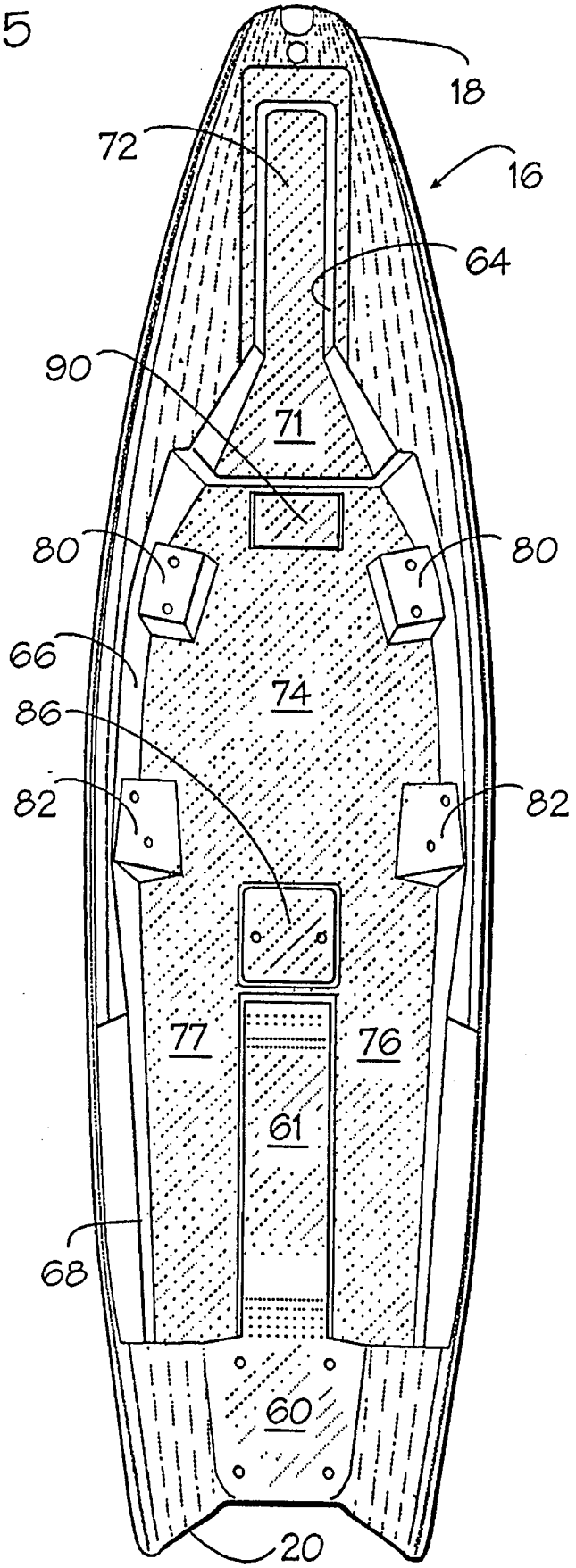
FIG. 5 is a top plan view of the hull bottom.

The mold assembly (not shown) includes a bottom mold, an interior mold and a top deck mold. Referring to FIGS. 3–5, the bottom mold produces a jet pump housing compartment 60 and the entire bottom hull shape 58 from bow 18 to stern 20 and half way up the entire contoured side rails 190A, 190B at a parting line. The interior mold produces the entire engine compartment and compartments for other mechanical components described herein. The contoured compartments 64, 66, 68 are outlined with a continuous vertical contoured overflowing wall that rises up and over onto the outside complex curved side rails 190A and 190B, shown in FIG. 6, that meet half way down the rail to the bottom mold. The unique design precisely locates the mechanical components to obtain the desired location of the craft center of gravity.

The hull design also forms the interior and bottom walls to produce the longitudinal stiffness and strength of the entire hollow hull 16. The bottom shell 50 and the interior shell 52 while in their respective molds are injected or poured with close cell foam and sandwiched or clamped together until cured with the interior flange mold. The top deck mold produces the entire contoured deck 54 and half of the rails 190A and 190B, minus the engine compartment hood 28. The top deck shell 54 in the mold is adhesively bonded together with a suitable resin or other adhesive of choice with the bottom mold. The molds are opened after curing the part. The top deck shell 54, the interior shell 52 and bottom shell 50 match at the same parting line and become one part. This produces a finished very high strength, high stiffness monolithic structure integrally reinforced in both the longitudinal and transverse directions that is not disclosed or suggested in the prior art.

The combination of the bonded contoured composite shaped top deck, shell 50 interior shell 52 and bottom shell 54 seals the entire water craft from any water intake into the hull foam and gives the hull 16 excellent flotation and strength superior to all previous motorized personal water craft. This sophisticated light composite shaped product and mold design allows the craft 10 to be assembled faster on an assembly line than other motorized high performance personal water craft such as Jet Skis and sit-down craft. The only assembly steps are drilling holes, tapping threads and inserting screw-in parts.

Most of the Jet Skis and sit down craft require additional steps in their assembly. Typical assembly of prior art watercraft includes gluing top deck, bottom hull and bulk head compartment walls and adding and gluing the foam in most of their assembly lines in fiberglass manufacturing.

Referring to FIGS. 2, 4, 6 and 8 the bottom shell 50 includes a pair of nose rail rockers 55A and 55B and a pair of curved cross-section side rails 57A and 57B. The term "rocker" as used herein refers to a vertical upwardly curved structure as viewed from the side of the craft. Near the stern 20, the bottom shell 50 has a pair of tail rail rockers 59A and 59B. The front rail rockers 55A and 55B, the side rails 57A and 57B and the rear rail rockers 59A and 59B facilitate making various types of turns and maneuvers as explained subsequently.

The strength and stiffness of the foam sandwich composite hull structure 16 is superior to any prior art personal water craft such as the current swivel jet stand-up (Jet Ski) and sit-down craft, Surf Jet motorized surfboard, or other lower speed craft such as those taught by Von Smagala-Romanov and Trotet. The weaker prior art composite structures typically feature only single composite vertical walls such as in commercial motorized personal watercraft or only reinforcement localized under the rider such as proposed by Sajic for a non-motorized paddle board.

In the current invention the structure of the hull 16 is critical for supporting the rider 12 and internal components in the craft 10 as it is exposed to the combined stresses from high normal and torsional loads due to high speed, high g-force turns; impact loads from the hull interacting with choppy seas at high speeds; high deck loads from aerial jumps, and vibration loads from the engine 108. In the preferred embodiment of the current invention, the hull 16 and the side rails 190A and 190B, best shown in FIGS. 6–8, all are constructed from low density closed cell foam core encapsulated by continuous fiber reinforced composite materials from bow 18 to stern 20. This unique monolithic curved shell hull assembly 16 is very efficient in reacting the high internal bending moments, shear and torsion loads of the craft created by the previously described maneuvers with minimum deflection and cyclic fatigue damage.

Further features of the invention, not applied in the prior art, are the highly sculptured interior compartments within the hull 16 that accommodate and precisely locate the placement of the internal components to achieve optimum location of craft center of gravity, pivot point and balance while simultaneously acting as internal longitudinal stiffening ribs. Also, composite reinforced metal mounting plate inserts for all mechanically attached components are integrally molded into the hull structure 16.

Figure 9:
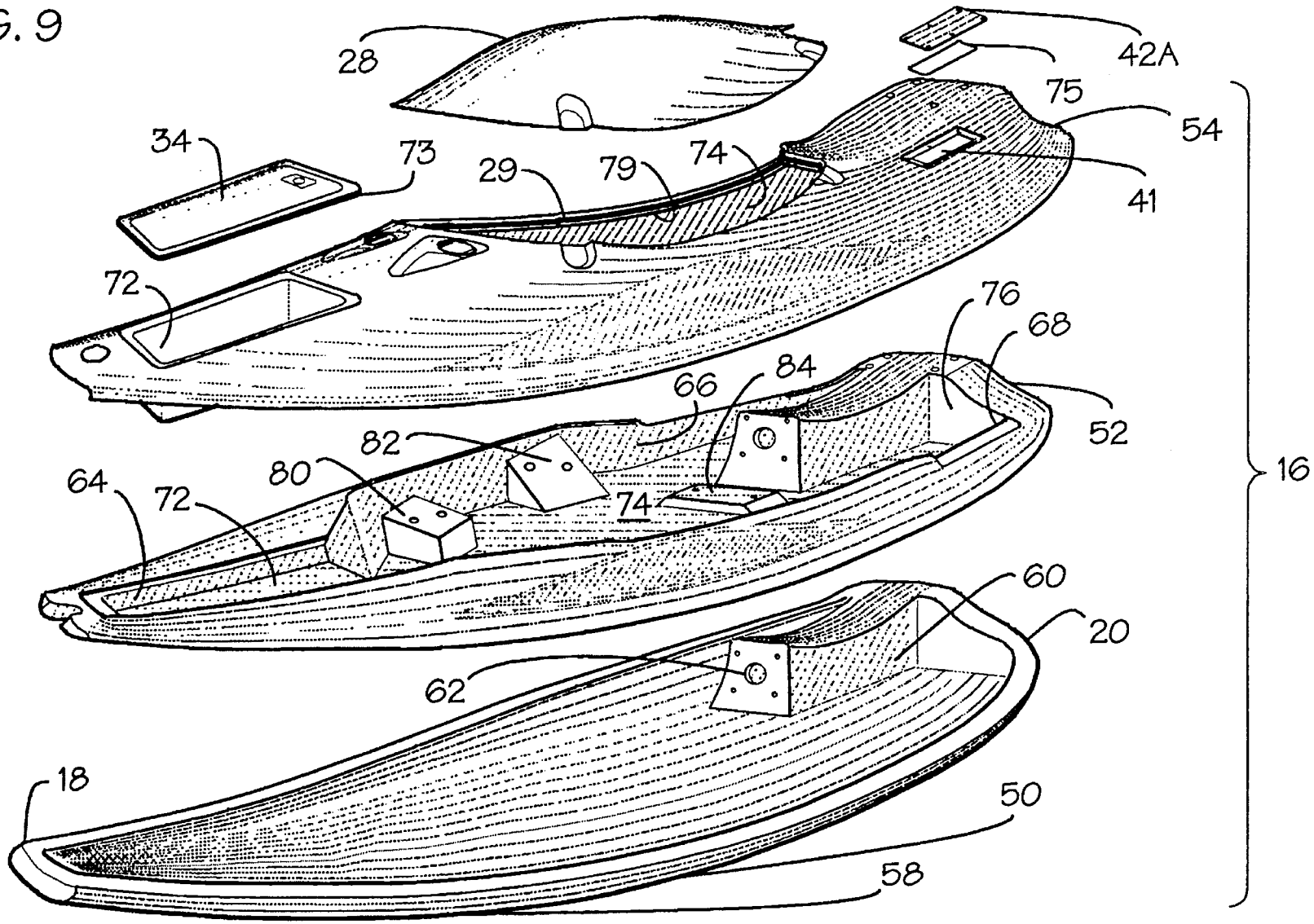
FIG. 9 is an exploded view of the motorized water ski in accordance with the present invention showing the bottom portion being composed of a bottom shell and a top shell along with a top and associated covers therefor.

The lower shell 50 includes a hull bottom 58 and a jet pump compartment 60 (best shown in FIG. 5). The jet pump drive shaft compartment 61 as shown in FIG. 5 has an access opening 62 therein as shown in FIGS. 3 and 9. Referring to FIG. 9, the top shell 52 includes generally vertical interior walls 64, 66 and 68, which provide longitudinal strength and stiffness to the high speed motorized water ski 10. The interior walls 64, 66, 68 enclose a bilge pump compartment 71, a fire extinguisher compartment 72, an engine compartment 74, a rear gas tank compartment 76, a rear engine exhaust compartment 77, and engine pod mounts 80 and 82. The fire extinguisher compartment cover 34 and the access covers 42A and 42B may be secured to the top deck 54 in any conventional manner. Sealing rings 73 and 75 are preferably included to provide a water-tight closure.

It should be noted that the forward vertical walls 64 join and are continuous with the walls 66. The walls 66 are continuous with the rear interior walls 68 to provide structural strength and stiffness to the water ski 10. The drive shaft compartment 61 is surrounded by a box structure whose top surface bonds in a uniquely strong sandwich with the deck 22. The deck 22 supports the 1000 to 1500 lb dynamic (approximately 4450 to 6675N) load of a rider in high g-force turns. The core of the sandwich is an advanced continuous fiber "egg-crate" composite material. A further feature of the structure is the reinforcement of the top deck engine compartment 74 access, utilizing a novel ranged composite lip 79, along with multiple ply composite reinforcement on the deck all around the access opening to the rails 190A and 190B and for a distance of about 6 inches from the bow 18 and stern 20.

Figure 10:
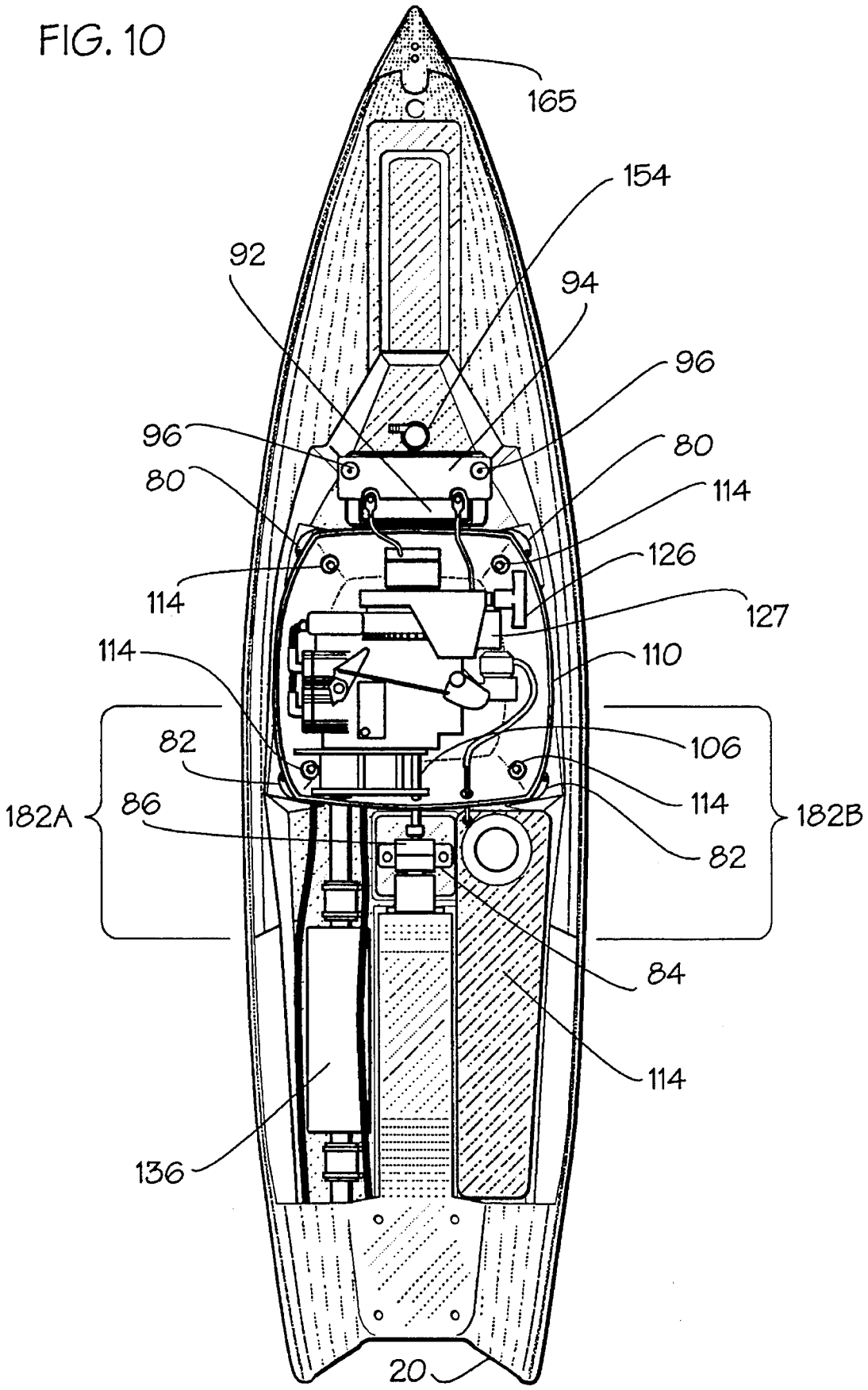
FIG. 10 is a top plan view of an assembled motorized water ski partially broken away to show the engine pod, engine and associated components.

Referring to FIG. 10, formed in the top shell 52 is a mount 84 for a drive shaft coupler 86. In addition, a forward mount 90 shown in FIG. 5 may be provided for supporting a battery 92 in a conventional manner by a top plate 94 and bolts 96, best shown in FIGS. 10 and 11.

Figure 11:
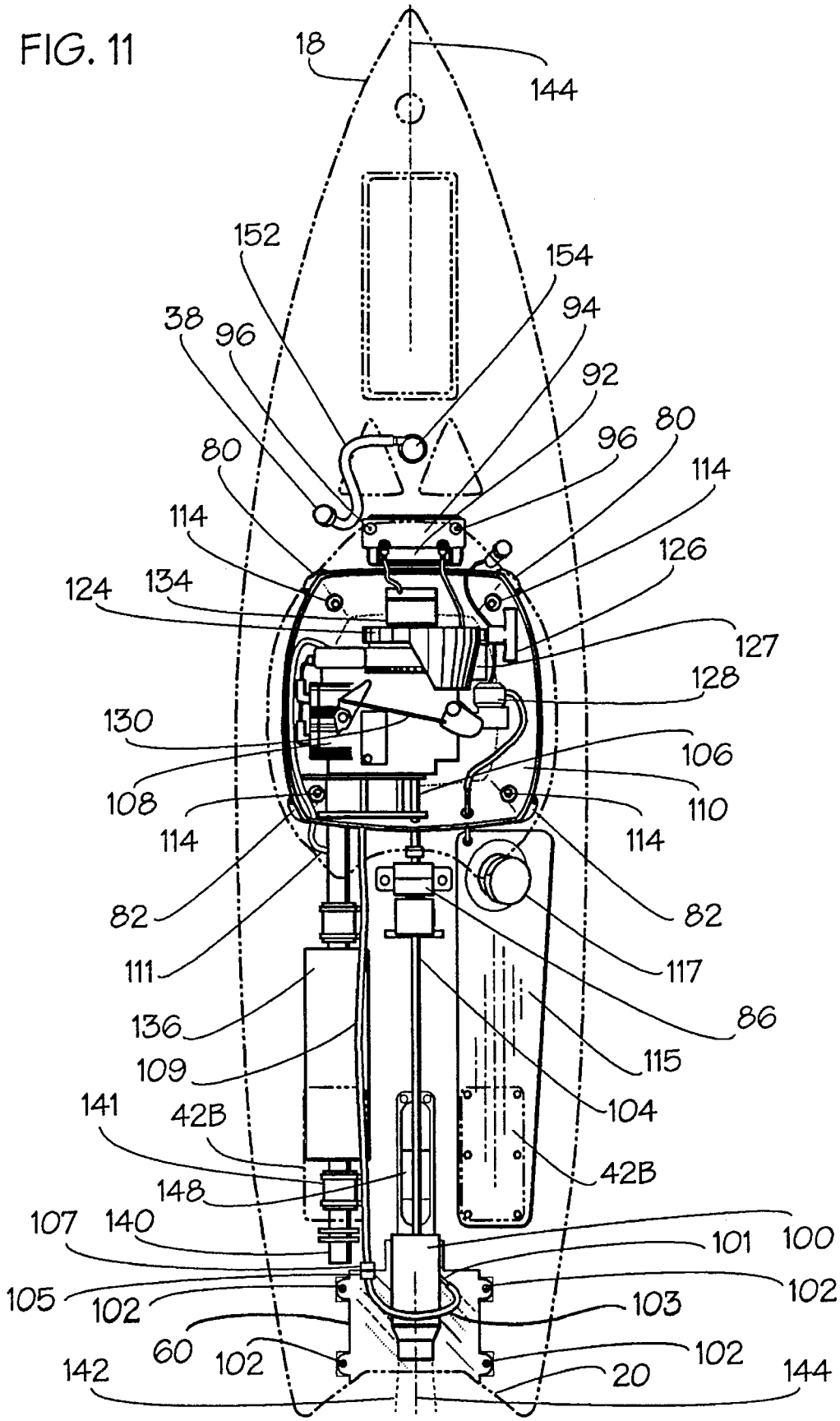
FIG. 11 is very similar to that shown in FIG. 10, at a different cross-section, showing further components.
Figure 12:
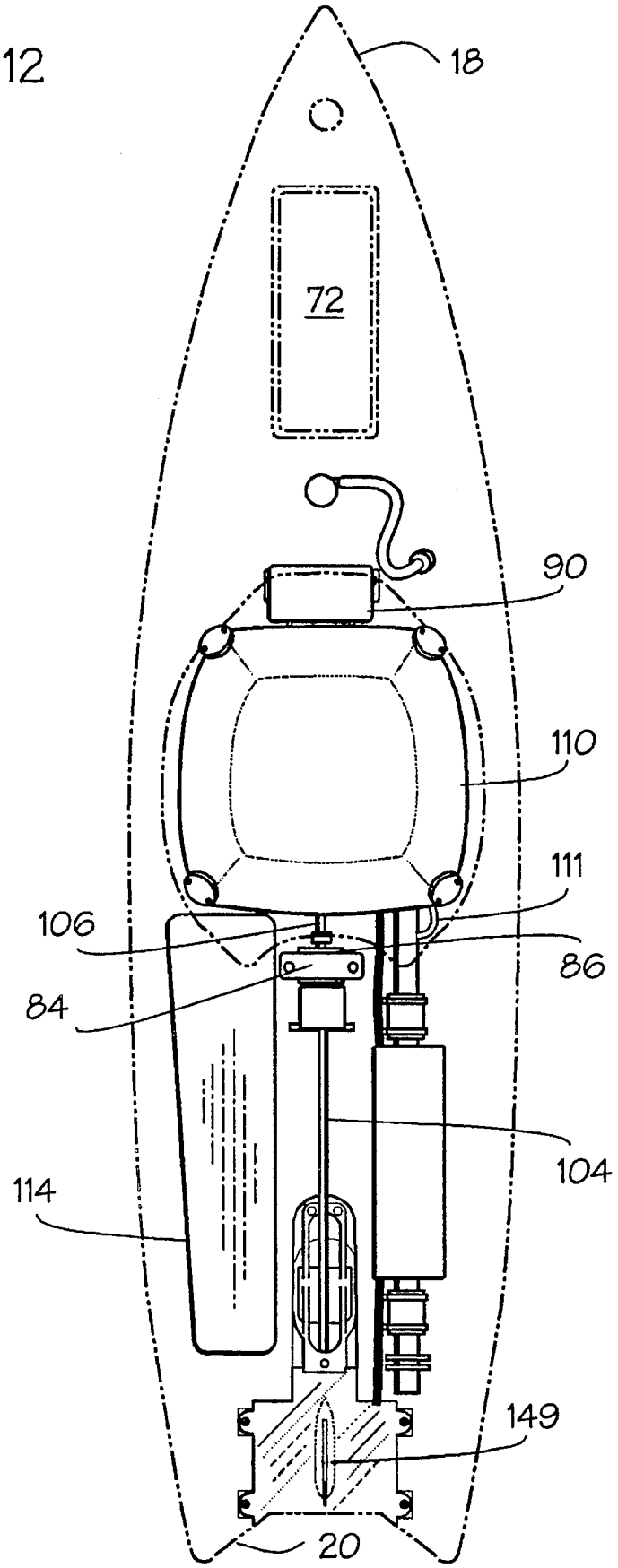
FIG. 12 is a bottom plan view of the motorized water ski, broken away to show an underside of the engine pod and associated components.
Figure 13:
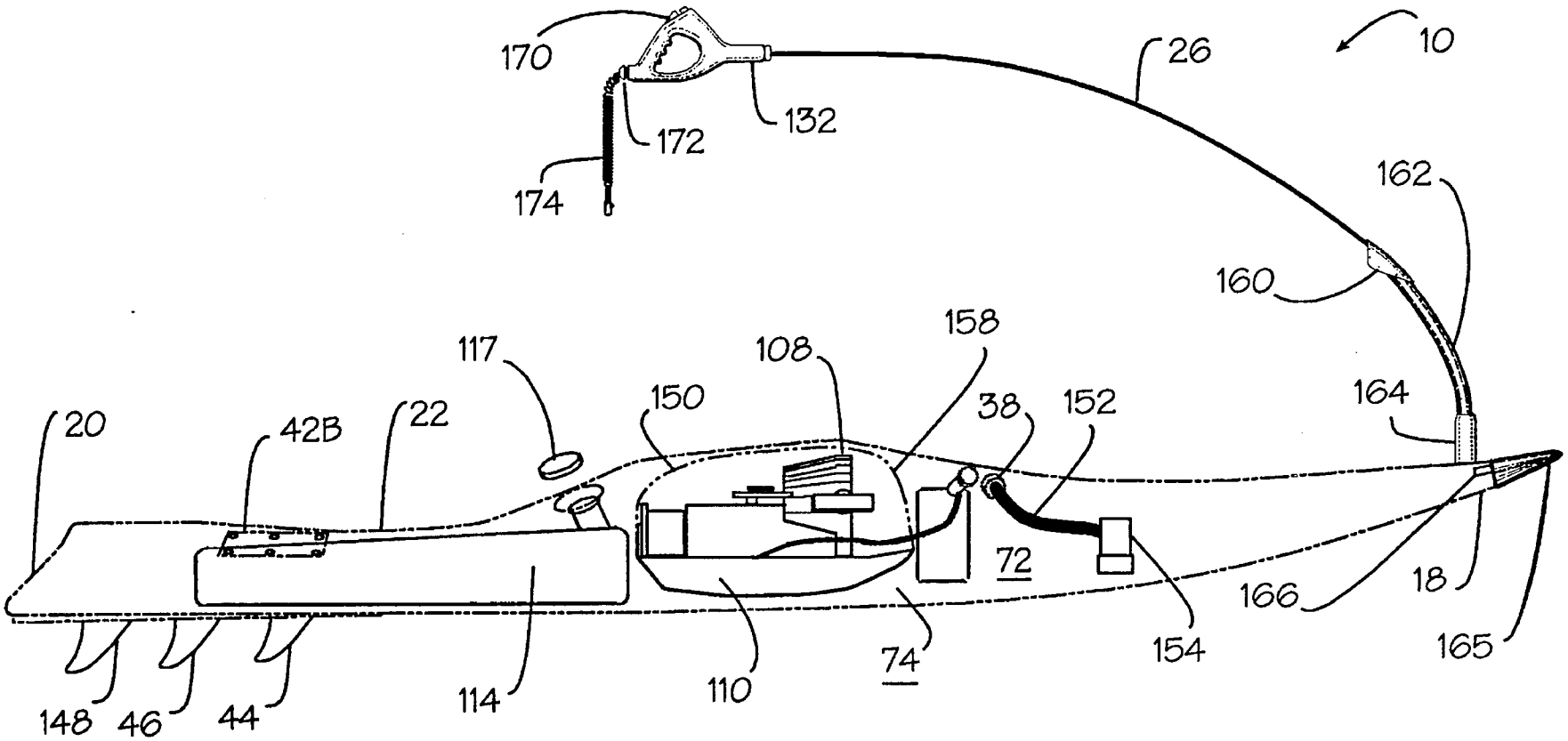
FIG. 13 is a side view of the motorized water ski, partially exploded and broken away to show an engine pod cover in relation to the hood of the engine compartment.

Turning now to FIGS. 11–13, an axial flow jet pump 100, which may be of any suitable commercial design capable of providing thrust preferably above 240 lb. (approximately 1068 Newtons), is secured within the pump compartment 60 by mounting bolts 102. The axial flow jet pump is connected by a drive shaft 104 to the drive shaft coupler 86. An engine drive shaft 106 is also connected to the drive shaft coupler 86. An internal combustion engine 108 is mounted to an engine pod 110 that is secured to the engine pod mounts 80 and 82 by bolts 114.

Preferably, the engine 108 has an output of about 15 to 55 horsepower (approximately 11 to 41 KW) to provide the necessary thrust. The water ski 10 preferably has a dry weight in the range of about 85 pounds to about 155 pounds (approximately 378 to 690 Newtons). The engine 108 is capable of propelling the water ski 10 at speeds up to about 35 miles per hour (approximately 56 km/hr) or more.

The engine pod 110 provides means for mounting the engine 108 below the level of the deck 22. The engine 108 is located a short distance in front of the deck 22 where the rider stands. The engine 108, the jet pump 100 and gas tank 115 with recessed gas cap 117 and exhaust system 136 are positioned in the hull to define a net center of gravity 120, shown in FIG. 14, beneath the deck portion 22 and rider 12. This location of the net center of gravity enables the rider 12, standing on the rear deck 22 within the length A, to turn the motorized water ski 10 solely by a shift in his stance or weight distribution on the deck portion 22. Careful selection of the location of the craft center of gravity will be hereinafter discussed in relation to the water ski length. There is no other high speed personal motorized water craft that can be steered in this manner by a rear-mounted, stand up rider.

Figure 14:
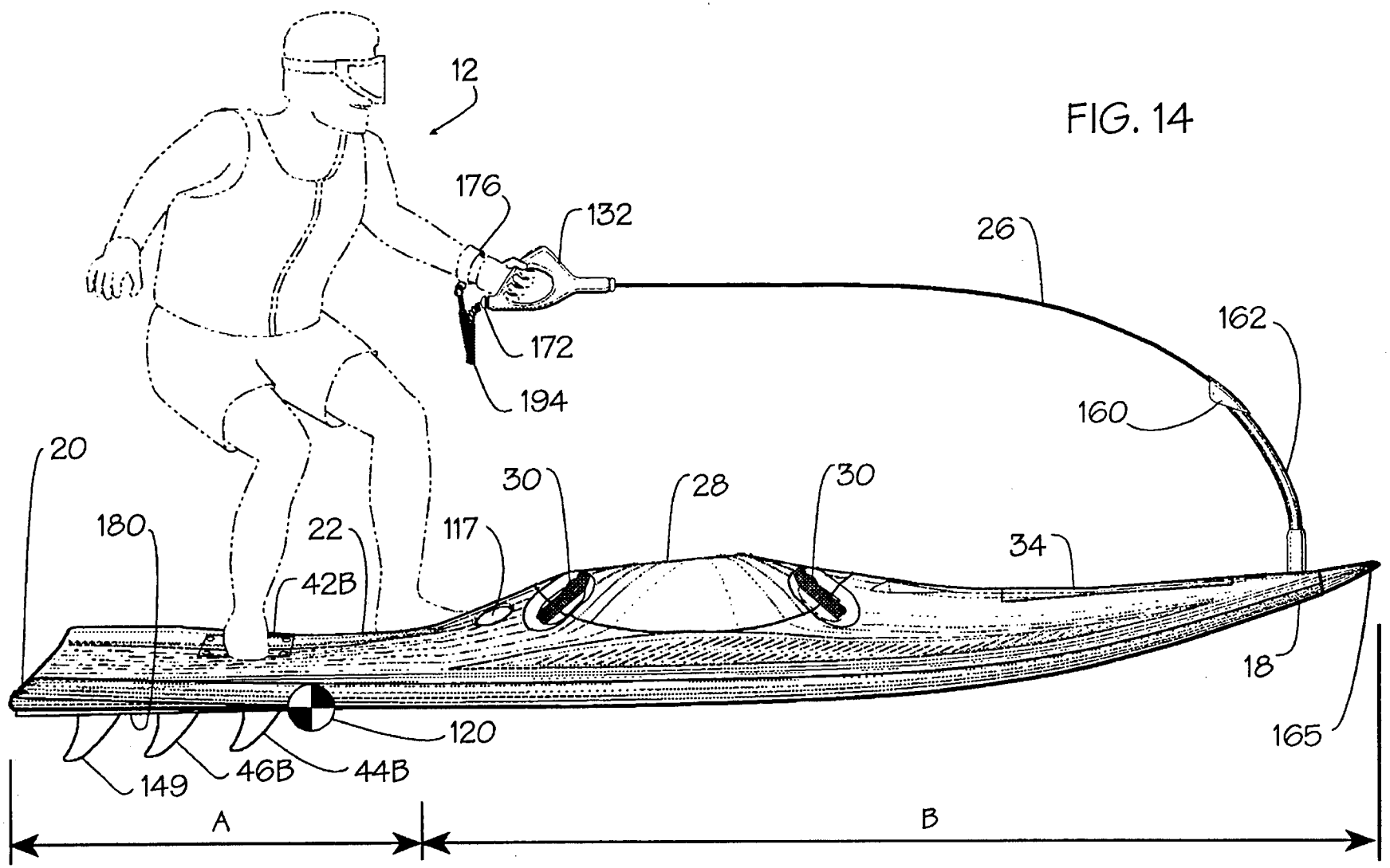
FIG. 14 is a side view of the motorized water ski in accordance with the present invention, illustrating the positioning of the net rider plus craft center of gravity envelope of the motorized water ski in relation to the rider.

Referring to FIGS. 14 and 16, in one preferred embodiment the mid-section, or beam, 182 of the motorized water ski 10 is approximately 27 inches (approximately 69 cm.) wide; and the stern 20 is approximately 15 inches (approximately 38 cm.) wide. In order to maintain a low profile, it is preferable that the engine 108 have a maximum height, when mounted, of less than about 10 inches (approximately 25 cm.). The engine 108 may include a conventional pull-start mechanism 124 having a handle 126. The engine may also include an electric starter 127 and a carburetor 128 having a throttle linkage 130, best shown in FIG. 11.

Figure 8:
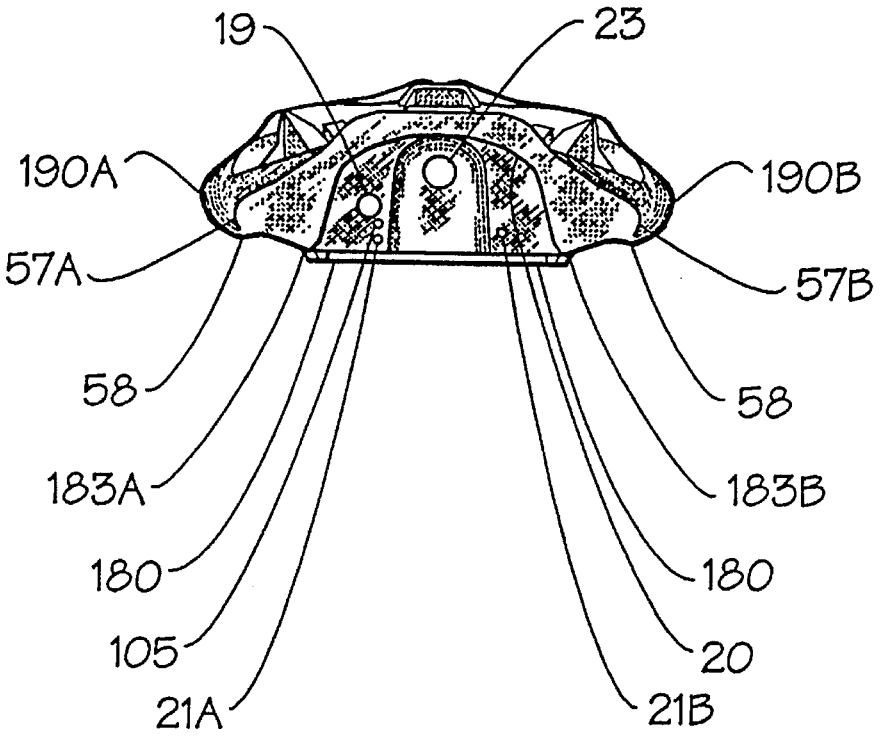
FIG. 8 is a rear view of the hull bottom.

After the engine 108 is started, it may be controlled via controls disposed within a hand grip 132, best shown in FIG. 13. The engine 108 may be controlled through the flexible arm pole 26 by way of an electrical relay system. The engine 108 may alternatively have controls that are directly connected to the hand grip 132 by a mechanical cable, not shown. An exhaust system 136, best shown in FIG. 11, is connected to the engine 108 for providing an acceptable sound level at a small exhaust pipe 140 that extends through an exhaust port hole 19 (FIG. 8). A rubber hose 141 connects the exhaust system 136 to the exhaust pipe 140.

The engine 108 and exhaust system 136 are cooled by pumping water from the axial flow jet pump 100. A Venturi intake fitting 101 is connected to a small intake hose 103 and then to another fitting 105 that connects through the rear compartment 76 and then to another fitting 107 on the engine water intake hose 109. The water circulates through the engine to the exhaust cooling line utilizing fitting 111.

Figure 15:
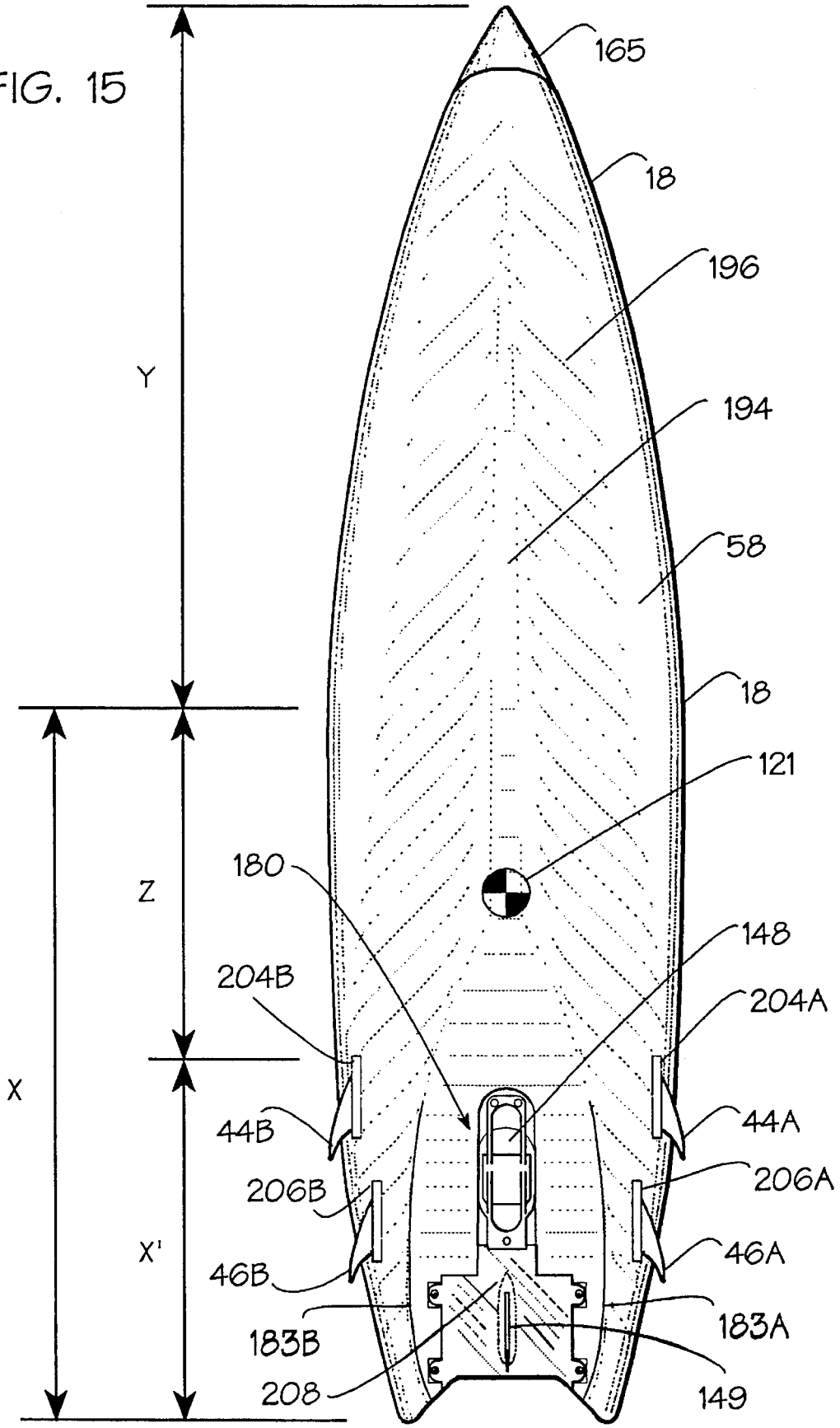
FIG. 15 is a bottom plan view of the motorized water craft showing the position of the riderless center of gravity and a flat hydroplane surface bounded by a hydrostep.

Referring to FIG. 11, the pump 100 is fixedly mounted in the stern 20 for discharging a propelling stream of water, as indicated by the dashed lines 142. The propelling stream of water is discharged outwardly from the stern 20 in a single unchangeable direction. The direction of the propelling stream of water is directed generally parallel to the longitudinal axis 144 of the motorized water ski 10. Water intake for the pump is provided by an intake grate 148 disposed in the hull bottom 58 as shown in FIG. 15. A central fin 149 may also be mounted along the longitudinal axis 144.

The motorized water ski 10 preferably includes a bilge pump 154 connected to the bilge pump outlet 38 by a conventional tube 152, as also shown in FIG. 13. Referring to FIG. 13, an engine pod cover 150 may be provided for further sound attenuation and additional water sealing of the engine 108 beneath the engine pod hood 28. It should be appreciated that the engine 108 is sealed within the pod 110 and pod cover 150 to prevent water entrance. Additionally, the pod 110 and cover 150 and the engine components contained therein are redundantly sealed within the water ski 10 by the engine compartment hood 28 and latches 30, with an appropriate elastomer or inflatable water seal 29 being used at the hood-deck interface. Air intake to the engine 108 is provided by an air intake opening 158, which communicates with the forward compartment 72. One way check valves (not shown) may be used for draining water from the internal cavity without permitting water ingress.

It should be appreciated that any suitable construction materials may be utilized in the fabrication of the motorized water ski 10, with appropriate methods and materials for joining components as necessary. As noted herein above, fiberglass, graphite fiber, polyester or epoxy resin and polyurethane or polystyrene foam are suitable materials of construction.

It is necessary to access the tail section of the hull inside the back wall of the exhaust 77 and gas tank compartment 76. This access is required for fitting and clamping of hoses and other components under the deck 22. All of the above-mentioned fittings for hoses, exhaust bilge pump, and water drainage have to be connected to mechanical components through the jet pump compartment housing walls 61 on both sides inside the hull exhaust compartment.

The clamping of these necessary mechanical components cannot be completed from the engine compartment 74 because of the required length of the gas tank 77, drive shaft 104, and exhaust chamber 76. Therefore, as shown in FIG. 9, there may be a pair of small openings 41A and 41B in the deck 22. These openings may be sealed by a corresponding pair of O-ring sealed deck plates 42A and 42B that may be removed for providing access to mechanical components under the deck 22. The size of the deck plates 42A and 42B should be only large enough to accommodate a person's hand or hands and tools for clamping these components properly. The design allows a rider to stand and jump on the entire rear deck area 22 at dynamic forces of up to 1500 lb. (approximately 6675N) during turning or jumping without damaging the deck plates. The small size of these hand access deck plates coupled with the structural design of the inside walls of exhaust 77, drive shaft 60, and gas tank 76 water tight compartments allows convenient, water tight, high strength access for maintenance and installation never before achieved in the personal water craft art.

Turning to FIG. 13, an arm pole air intake 160 communicating with the forward compartment 72 through a tube 162 and fitting 164 provides means for introducing air to the engine 108. The arm pole air intake 160 disposed in the arm pole 26 at a point elevated from the bow, for example, up to 12 inches or more to prevent the entry of water during use. Hence, the motorized water ski 10 may be completely submerged during operation up to the arm pole air intake 160 without the introduction of water into the forward compartment 72 or the engine compartment 74. Further protection for the engine is, of course, provided by the sealed arrangement between the pod 110 and pod cover 150 and redundantly by the sealed engine hood 28. Any water entering the forward engine compartment 72 is removed by the bilge pump 154 before it reaches the air intake 158 of the engine pod cover 150. In addition, the arm pole air intake 160 is rearwardly facing to reduce water entry during operation of the water ski 10. Manual one-way drain valves 21A and 21B may also be provided.

Referring still to FIG. 13, also fitted to the bow 18 is a replaceable safety nose piece 165 preferably formed from rubber or silicone. The nose piece 165 is fitted to the bow 18 by a tongue-in-groove fitting 166 which may be secured by screws or the like (not shown). This a unique feature that is not shown in the prior art.

The arm pole 26 terminates in the universal left or right hand grip 132 which includes finger controls 170, preferably a thumb-actuated throttle 170A, a starter 170B and a stop switch 170C connected to the engine 108 either mechanically or electrically for controlling engine speed. The hand grip is configured to be suitable for operation by one hand of the rider 12. The thumb-actuated throttle 170A is a unique safety feature that prevents the rider 12 from inadvertently depressing the throttle if he loses his balance while gripping the hand grip 132 with his other four fingers. The one handed universal left or right hand grip 132 differs from the grips used in the prior art personal watercraft where two-handed handles are required for control and balance. In water skiing a two handed grip is required so that the rider can maintain stability throughout a sharp turn. In the present invention the free hand can be used for balance and leverage while making turns as shown in FIGS. 1*a*–1*c*.

In addition, a dead man switch 172 is attached by a cord 174 to the rider's wrist 176 to cause the engine 108 to turn off should the rider 12 fall from the water ski 10. The details of the dead man switch are not shown here because this is a well-known conventional feature mandated by law in most jurisdictions.

As shown in FIG. 15, the craft center of gravity 121 of the empty, riderless motorized water ski 10 in accordance with the present invention is disposed behind the beam 182A, 182B. The beam is defined as the widest portion of the motorized water ski 10 when it is seen in a plan view. The shape and weight distribution of the hull 16 and the locations of the jet pump 100, the engine 108, gas tank 115, exhaust system 136 and other components of the motorized water ski 10 are selected and formed so that the craft center of gravity 121 is located on a vertical plane lying on the craft longitudinal axis 144, shown in FIG. 11, within the length Z of FIG. 15.

The craft center of gravity 121 (FIG. 15) is determined by the structure of the hull 16 and placement of internal components. The structure of the motorized water ski 10 is designed so that its center of gravity 121 falls within an envelope or range located above the flat keel 17 portion (FIG. 4) of the hull 16. Therefore, at high speeds of up 30 miles per hour (approximately 50 km/hr) or more, directional control of the motorized water ski 10 is accomplished by a change in the rider's stance or weight distribution while he is positioned in a preferred location that is approximately over the net center of gravity 120 of the rider 12 and motorized water ski 10.

Referring to FIG. 14, when the rider 12 stands on the deck 22, the net center of gravity 120 of the motorized water ski 10 and rider 12 is rearward of the craft center of gravity 121 (shown in FIG. 15) of the riderless motorized water ski 10. It is assumed that the average rider will weigh between about 80 pounds and 250 pounds (approximately 356 to 1112 Newtons). The range, or envelope, of the position of the net center of gravity 120, depending on the rider's weight and position, is shown by the double headed arrow A in FIG. 14. The arrow A represents a range of locations of about 70% to 100% of the length of the motorized water ski 10 measured from the bow 18 and bounded laterally by the side rails 190A and 190B. It has been found that the riderless center of gravity 121 preferably is disposed more than 50 percent of the length of the water ski 10 from the bow 18 approximately on the longitudinal center line 144. Placement of the craft center of gravity 121 should be in the range or envelope indicated by the double headed arrow Z shown in FIG. 15 which lies behind the bow 18 at least a distance Y. The total length of the water ski is represented by the length of the lines Y+X. The ratio of Y/(Y+X) is preferably between 0.50 and 0.75. Therefore, when the rider of average weight stands on the deck 22, the net center of gravity will lie in the general region of the rider and above the hydroplane surface 180. The structure of the motorized water ski 10 that allows the longitudinal and transverse coordinates of the net center of gravity to lie below the rider is an important feature that permits a change in position and weight distribution of the rear mounted standing rider 12 to be effective in initiating and maintaining a turn of a desired radius in water without the use of a mechanical turning device. This is described in detail subsequently.

Another feature of the present motorized water ski 10 is a low profile. Particularly, the profile of the top deck at the stern 20 and deck portion 22 enables a rider to board the motorized water ski while it is in water as shown in FIG. 10.

Figure 6:
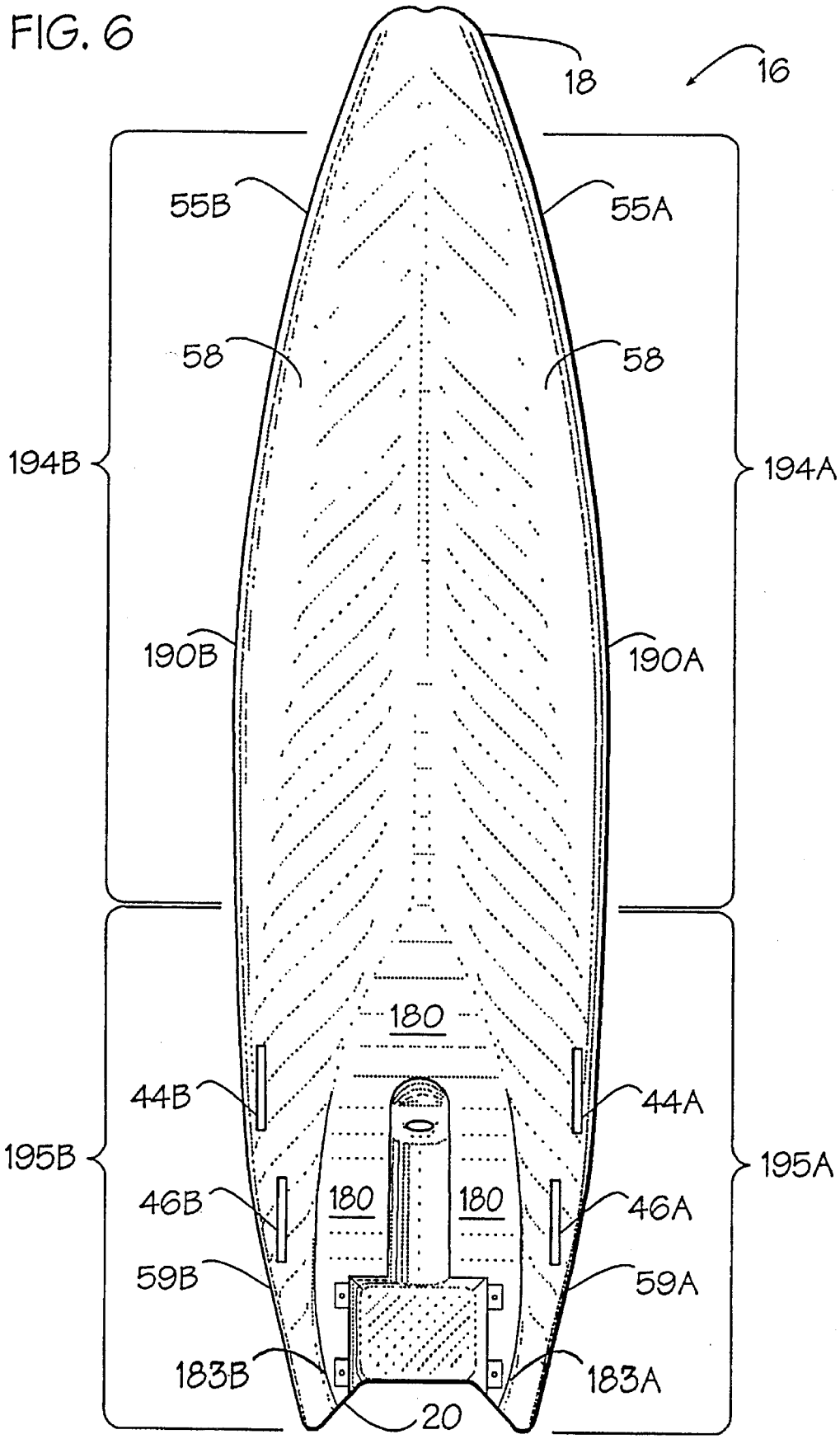
FIG. 6 is a bottom plan view of the hull bottom.

The combination of design features of the bottom hull 58 and side rails 190A as shown generally in FIG. 6, has never before been used in personal water craft, and are a novel part of this invention. These features, in conjunction with the placement of the craft center of gravity and control of thrust, enable the rear mounted standing rider to select a variety of operating characteristics for maximum control and stability during straightway high and low speed cruising and during high and low speed turns.

Figure 7:
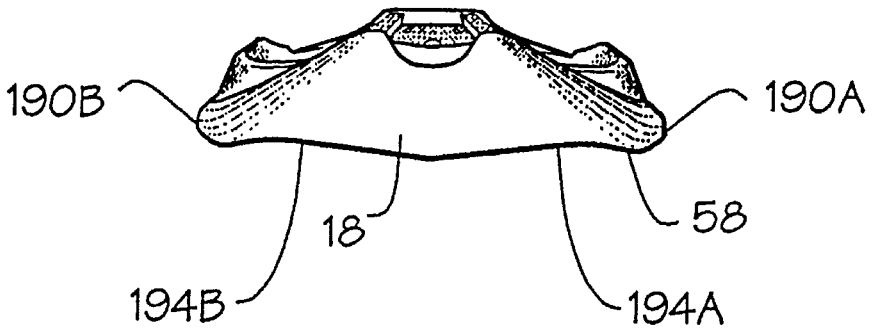
FIG. 7 is a front view of the hull bottom.

The side rails 190A and 190B run the entire length of the craft and bound the hull bottom 58 on both port and starboard as best shown in FIGS. 7 and 8, and provide the rider stability and precise control during turns as shown in FIGS. 1A and 1B. The rails have complex curve cross-sections 57A and 57B, that assist the rider 12 in achieving the desired sharpness of turns and setting the angle of thrust during turns as explained subsequently. The rails 190A and 190B also have vertical upward curvatures or front rail rockers 55A and 55B at the bow 18 and rear rail rockers 59A and 59B near the stern 20, as shown best in FIG. 6. The front rail rockers 55A and 55B act to decrease drag at low speeds prior to hydroplaning and assist in controlling the sharpness of high speed turns. The rear rail rockers 59A and 59B assist in the control of the sharpness of lower speed, small radius thrust assisted turns.

Referring again to FIG. 6, 7 and 8, the hull bottom 58 features forward soft low angle "V" surfaces 194A and 194B extending from the bow 18 to the beam 182 and 182 B, which reduce straightway cruising drag at lower speeds prior to hydroplaning. The rear "V" surfaces 195A and 195B extend aft from the beam 182 at an increasingly higher angle to the stern, where they connect the side rails 190A and 190B with the hydrostep 183A and 183B which bound the flat hydroplane surface 180. The forward end of the rear "V" surfaces located between the beam 182 and the beginning of the sharply defined hydrostep 183A and 183B facilitates executing partial sharp zig-zag maneuvers, while the sharp rear portions of the "V" surfaces 195A and 195B provides leverage for the rider 12 to move from the hydroplane surface 180 to the selected rail 190A or 190B to initiate turns.

Referring again to FIG. 6, the hydroplane surface 180, located directly under the deck 22 is bounded by a blended radius with the rear "V" 195A and 195B surfaces forward of the pump water inlet 148 in order to minimize aeration, with the abrupt hydrostep 183A and 183B beginning aft of the inlet 148 to achieve rapid release of water during transition of the craft 10 to high speed hydroplaning. The hydroplane surface 180 provides stability and low drag efficient operation as soon as the pump 100 provides sufficient thrust to achieve hydroplaning speeds above about 10 miles per hour. In addition the position of the net center of gravity, 120 under the rider 12 as shown in FIG. 14, enables the ski 10 to come to speed without the rider leaning forward with his weight to stabilize the craft from porpoising as is necessary in prior art watercraft with standing rear mounted riders. The flat center keel 17, shown in FIG. 4, extends from forward of the beam 182, then aft to merge with the flat hydrostep 182 which begins at a point forward of the pump inlet grate 148 and proceeds aft in a "mini surfboard" shape as shown best in FIG. 6. The flat center keel 17 helps prevent porpoising of the ski 10 in the water.

The unique design of the hull 58, combined with the side rails 190A and 190B and the low net center of gravity 12 positioned underneath the rider 12 provides unique stability for a rear mounted beginning rider. For example if an inexperienced rider leans, by accident, left or right while planing, there is no unstable abrupt tipping from side to side or unstable sliding left or right of the stern 20 which would cause loss of balance and perhaps throwing of the rider off the ski. The craft smoothly transitions from the hydroplane surface 180, through the side "V" surfaces 195A or 195B to the rails 190A or 190B and a gradual sliding turn of the ski is negotiated under control of the rider 12.

This novel combination of bottom hull and side rail configuration in conjunction with the location of the net center of gravity and proper application of thrust allows the rider to have precise control of the craft as described subsequently.

Also providing stability are the fins 44A, 44B, 46A, 46B and 149 which minimize lateral sliding of the water ski 10 in turns. As best seen in FIG. 15, the fins 44A, 44B, 46A, 46B and 149 are disposed in slots 204A, 204B, 206A, 206B and 208, respectively, and may be pivotally mounted or spring mounted, not shown, for enabling the fins 44A, 44B, 46A, 46B and 149 to retract into the rear compartments 76 as a safety feature and to enable ramp jumping with the motorized water ski 10.

Method of Operation of the Motorized Water Ski

The high performance operation of the craft 10 is directly related to the application of a unique combination of structural features. These feature include thrust, engine power, buoyancy, precisely located craft center of gravity, bottom hull design and side rail design. To obtain the required high speed performance, the axial flow water jet pump 100 in the current invention must deliver sufficient thrust to rapidly accelerate the craft 10 and maintain its speed, which is preferably from 30 miles per hour (approximately 50 km/h) to in excess of 40 miles per hour (approximately 64 km/h). To overcome both the resistance of the water acting on the craft 10 and the resistance of air on the rider and the craft 10, the required thrust for achieving this range of speeds was calculated to be in the range from 130 pounds (approximately 580 Newtons) to about 330 pounds (approximately 1468.5 Newtons). In a preferred embodiment of the invention, a craft speed of 32 to 35 miles per hour (approximately 51 to 56 km/h) was measured on flat water at a measured pump thrust of about 240 to 265 pounds (approximately 1068 to 1179 Newtons).

The engine 108 must have sufficient power to propel the craft 10 and rider at the desired range of speeds stated above. The required engine power depends on the energy consumed per second to move the mass of the rider plus craft 10 through the water at the desired speed. This power is a function of the kinetic energy of the craft 10 and rider plus the work done in overcoming drag forces from the air and water and the efficiency of the jet drive pump system. For the desired range of speeds and applicable range of rider plus craft 10 weights of from about 250 pounds (approximately 1112 Newtons) minimum to about 400 pounds (approximately 1780 Newtons) maximum, engine powers of from 14 HP (approximately 10.4 KW)to about 55 HP (approximately 41 KW) are required.

In one preferred embodiment of the invention, a craft 10 plus rider with a total weight of about 350 pounds (approximately 1560 Newtons) achieved a constant measured speed of above 32 to 35 miles per hour (approximately 51 to 56 km/h)with an engine 108 rated at 25 HP (approximately 18.6 KW) output power, The relatively high weight of the required highly powered engine 108 ranges from 30% to 50% of the total weight of the craft 10, which requires careful placement of the engine 108 within the hull to allow a rear mounted rider to pivot the craft 10 and perform stable turns without the use of a steering mechanism.

The buoyancy of the craft 10 is designed to neutrally support a rider of up to about 250 pounds (approximately 1112 Newtons) while simultaneously supporting an additional 90 to 150 pounds (approximately 400 to 667.5 Newtons) of weight from the craft 10 structure and mechanical components, without submerging the top of the engine compartment hood 28. This is achieved by a precisely calculated craft 10 volume, weight and center of buoyancy relative to the location of the center of gravity 121 of the craft 10. Once hydroplaning is achieved, the natural (static) buoyancy becomes less important, being dominated by the vertical hydrodynamic components of force on the rear of the craft 10, controlled by the thrust and speed.

The center of gravity 121 of the craft 10 is critical to performance, stability and the ability of a rear mounted rider to initiate and negotiate controlled low speed and high speed turns (FIGS. 1*a* and 1*b*) without the use of a turning mechanism. This control by a rider mounted on the rear deck is achieved by positioning, the center of gravity 121 of the craft 10 on the craft 10 longitudinal center line 144 in front of the rider and at a horizontal distance in the range of about 50% to 75% from the bow.

The weight of a typical rider is in the range of 1.0 to 1.75 times that of the craft 10. As the typical rider 12 stands in a sideways stance on the rear deck 22, the net center of gravity 120 of the rider plus craft 10 moves to a preferred position on the longitudinal center plane of the craft 10. The longitudinal and transverse coordinates of the net center of gravity 120 typically are located in the region beneath the rider and between the position of his front and back feet. In this case the net center of gravity 120 is referred to as an "intelligent CG" because the rider is able to easily move the net center of gravity 120 forward, aft, left or right to control the craft 10 by only slight body movement or weight shift.

For example during take off, the rider leans forward in a standing position or lies on the craft 10 with his chest just behind the engine 108 to move the net center of gravity 120 forward toward the location of the mechanical center of gravity 121 and applies thrust, thus facilitating rapid transitioning of the craft 10 to a hydroplaning condition. Then the rider leans back if standing (or stands up if lying down) to move the net center of gravity 120 in a projected area near his feet for stable high speed straight line operation. The rider turns the craft 10 by slightly adjusting his weight distribution or position of his rear foot generally forward and in a transverse direction to the craft's longitudinal axis 144 in the direction of the desired turn. This moves the net center of gravity 120 slightly forward and in the direction of the desired turn (left or right), and places the pivot point inside the selected rail 194A or 194B in the region of the rider, thus producing a stable turn. The rider can adjust the angle of the turn by the degree to which he shifts his body weight rearward and to the left or right of the longitudinal centerline 144. The rider 12 can negotiate both high speed, high g-force turns and low speed turns as described later.

Precisely locating the craft 10 center of gravity 121 and the net craft 10 plus rider 12 center of gravity 120 is a key element of this invention. A large number of calculations and experiments regarding hull structure, placement of mechanical components and position of the rider 12 were required to achieve the preferred embodiment. These calculations and experiments took into account both the weight and weight distribution of the empty hull 16 structure and the weight and location of the mechanical components within the craft 10 and the weight range and location of the rider 12.

Unlike the prior art craft 10 with no steering mechanisms, for the considerably higher powers and thrusts required in this invention, the total weights of the mechanical components including engine 108 assembly, jet pump assembly 100 and fuel tank 114 are generally equal to or greater than the weight of the craft 10 structure. This is shown below for a range of intended models and one specific preferred embodiment. Unlike the previous art, the high power engine 108 dominates the weight of the mechanical components and its placement in front of the rider dominates the calculation of the center of gravity 121 of the craft 10, determined by calculating, for each of three mutually orthogonal directions, the summation of the product of the individual masses times the distances from a reference datum divided by the sum of the masses. Table I gives representative values of the weights of various components of the craft 10 along with values for a specific preferred embodiment.

TABLE I

| Component | Weight Range (Lb.) | Pref. Embodiment (lb.) |
|---|---|---|
| Empty Hull | 35–60 | 55 |
| Engine & Pod | 30–80 | 59 |
| Battery & Housing | 5–15 | 13.5 |
| Jet Pump Assembly | 7–20 | 12 |
| Fuel Tank | 2–5 | 4 |
| Exhaust System | 3–8 | 4.5 |
| Arm Pole Assembly | 6–12 | 11 |

Even slight variations of the positions of heavy components of the craft 10 has a significant effect on the location of the center of gravity of the craft 10. Slight variations in component position also have significant effects on the performance and handling of the craft 10. In one preferred embodiment of the invention, the approximately 59 pound (approximately 263 Newton), 25 HP (approximately 18.6 KW) engine assembly and the mechanical components are positioned in the craft 10 such that the center of gravity 121 of the craft 10 is positioned at a distance of 62.5% of the total length from the bow, about 1.5 ft. (approximately 0.45 m) in front of the net center of gravity 120 when a rear mounted rider of average adult body weight is in a typical position for straightway high speed planing. As discussed previously, in order to achieve the desired handling characteristics and provide stability and speed for a rear mounted rider experiments showed that the center of gravity 121 of the craft 10 must be located in the range of 50% to 75% of the total craft 10 length measured from the bow on the longitudinal axis of the craft 10 and about midway between the top shell 52 and bottom shell 50 on the vertical axis.

The coordinated design of the hull bottom 58 and side rails 190A and 190B in the present invention is critical to achieving both high speed, controlled high g-force turns and low speed turns without the use of any turning mechanism or variable-direction jet. The hull 16 features a unique combination of the flat hydroplane surface 180 near the stern 20 that transitions laterally through "V" shaped surfaces 195A and 195B to the outer curved cross section rails 190A and 190B. This hull-rail design operates in conjunction with the net center of gravity 120 of the craft 10 and rider to enable a stable transition from low speed startup to high speed straight planing and easy initiation and execution of smooth and controllable high and low speed turns. The unique combination of bottom hull 58 and rail 190A, 190B design features offers the rider optimum choices for operation in a variety of modes. During start-up the abrupt hydrostep 183A, 183B bordering the hydroplane surface 180 facilitates release from the water on application of thrust, which results in the rapid transition to stable high speed hydroplaning where both the wetted hull surface and resultant drag forces are minimized. The hydrosteps 183A, 183B vary from negligible height at the forward initiation point of the hydroplane surface 180 to a maximum height at the stern 20 of 1 to 4 inches (approximately 2.5 cm to 10.0 cm) high, depending on desired responsiveness during turns or maneuvers.

The hydroplane surface 180 is generally shaped like a miniature surfboard. The hydroplane surface 180 begins well in front of the pump intake 148 and mates with the center of keel 17 which proceeds aft without any rocker (or vertical curve) and acts to resist vertical porpoising of the craft 10 while lowering drag and stabilizing the craft 10 during high speed operation. The "V" surfaces 195A and 195B to the side of the hydroplane surface 180 connect the base of the hydroplane surface 180 with the outer rails. The interface lines of the "V"-shaped surfaces 195A and 195B and the hydroplane surface 180 are blended smoothly forward of the jet pump intake 148 to minimize aeration into the pump 100. Sharp edges 183A and 183B in the hydrostep begins at the forward edge of the jet pump intake 148 and proceeds aft, thus promoting hydrodynamic release of the water off the sharp edges thereby reducing drag. The full "V" shaped hull portions 194A and 194B forward of the hydroplane surface 180 assists the rider in initiating rapid zig-zag turn maneuvers with minimum effort.

When the rider shifts his weight left or right to initiate a full turn, the craft 10 rolls from the flat hydroplane surface 180, to the adjacent "V" surfaces 195A and 195B, which increase in angle towards the bow 18 and provides the rider 12 with leverage to submerge the curved rails 190A and 190B by means of his weight shift on the deck 22, thus initiating a turn. The rider 12 then glides on the selected rail 190A or 190B, proceeding from the stern portion to the mid portion of the rail for high speed turns and remaining on the stern rocker portion of the rail 59A, 59B in lower speed turns where thrust is used to change the direction of the craft 10. The hydrodynamic drag forces on the submerged portion of the rail, in conjunction with the position of the net center of gravity 120 and predefined pivot point under the rider 12, produce controlled smooth high speed and low speed turns with no abrupt movement to destabilize the rider 12. The side rail rockers 59A, 59B that curve vertically upwards near the stern 20 enable the rider 12 to use his weight shift to control the speed of response of the craft 10 during turns. In high speed turns the complex curved cross section rail surfaces 57A and 57B acts like a motorcycle tire in setting the final angle and direction of the turn. The fins 44A, 44B, 46A, 46B and 149 act to prevent over-rotation of the hull and prevent sliding during both low speed and high speed turns. One to five fins suitably placed fins may be used, depending on the required performance characteristics. As an alternative, low profile retractable "Bonsai" type fins can be used.

During low speed, short radius turns as shown in FIG. 1B at speeds between 5 to 10 miles per hour (approximately 8 to 16 kin/h), the rider 12 shifts the net center of gravity 120 aft and in the direction of the desired turn. This sinks the aft rocker end of the rails 59A, 59B, and the rider 12 simultaneously uses high thrust bursts of the water jet to accelerate through the short radius turn having a radius typically in the range of 3 to 4 feet (approximately 0.9 to 1.2 m) with high stability. In this type of turn the craft pivots around the net center of gravity 120 without the use of a steering mechanism or maneuverable jet as required by the prior art. A more extreme spin maneuver shown in FIG. 1C can also be achieved in which a major portion of the craft is lifted out of the water by the rider 12 shifting his weight and net center of gravity 120 even further aft toward the stern 20 by leaning backwards and by applying maximum thrust of greater than 200 lb. (approximately 890 Newtons). This results in a significant component of thrust in the vertical direction that lifts much of the craft 10 out of the water while pivoting the craft 10 and rider 12.

The unique combination of high thrust, precision craft center of gravity 121 positioning and bottom hull/rail configuration enables the craft 10 and rear mounted standing rider 12 to negotiate stable controlled high speed turns never before achievable on a stand up, rear mounted personal water craft with non-directional thrust. The rider 12 experiences peak forces of between 3 and 6 times the force of gravity during such turn as measured with one preferred embodiment of the invention as listed in Table II.

TABLE II

| Turn Radius (ft) | Max. Tangential Speed (mph) | Peak Centripetal Force (g's) |
|---|---|---|
| 25 | 34 | 3.1 |
| 15 | 32 | 4.6 |
| 10 | 30 | 6.0 |

The high centripetal force allows the rider 12 to negotiate high speed turns at approximate angles of his body axis to the water surface of 15 to 20 degrees, as he is stabilized by both the upward vertical component of the reaction force and the friction force of his feet on the deck 22 acting against the vertically downward force of his weight. For example, a 200 pound rider 12 would experience the following forces acting against the vertically downward 200 pound force of his weight, thus preventing him from falling or slipping off the craft 10 as he negotiates a high speed turn. Table HI gives forces on the rider 12 for two different angles between the rider's body and the water during a turn of the watercraft according to the present invention.

TABLE III

| Angle of Body to Water Surface | Peak Cenitripetal Force (g's) | Vertical Force (lb.) | Friction Force (lb.) |
|---|---|---|---|
| 20° | 3 | 205 | 120 |
| 15° | 4 | 207 | 160 |

The controlled and stable high g-force turns that can be performed by a standing rider 12 without an active mechanical steering mechanism by a rear mounted standing rider 12 with the present invention have never been achieved in personal water craft or in water skiing where the tension on the rope connected to the boat and the skier's arm tends to produce destabilizing forces on the skier.

The structures and methods disclosed herein illustrate the principles of the present invention. The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention.

What is claimed is:

1. A high speed motorized water ski (10) that has stability and maneuverability for a rear mounted rider (12) at both low and high speeds, comprising:

a hull (16) having a bow (18), a stern (20), a deck (22) sized for accommodating the standing rider (12), a hydroplane surface (180) formed on the hull (16) and a longitudinal axis (144) extending from the bow (18) to the stern (20);

a pair of curved side rails (190A and 190B) formed on opposite sides of the hull (16);

a hull bottom (58) having a first "V"-shaped portion (194A, 194B) forward of the widest beam portion (182A, 182B) of the hull (16) the "V" shape (194A, 194B) transitioning aft along the hull bottom (58) to a flat keel (17) and then to a second "V" shaped portion (195A 195B) between the hydroplane surface (180) and the curved side rails (190A, 190B) the second "V"-shaped portion (195A and 195B), the curved side rails (190A, 190B) cooperating with the rider's movement of the net center of gravity (120) to enable smooth transition from startup to high speed planing and easy initiation and execution of high and low speed turns;

a pump (100) fixedly mounted in the stern (20) for discharging a propelling stream of water outwardly from the stern (20) in a direction fixed to be generally parallel with the longitudinal axis (144) of the high speed motorized water ski (10);

a motor (108) disposed within the hull (16) for driving the pump (100), the motor (108) being mounted in the hull (16) forward of the deck (22), thus enabling easy deep water mounting of the high speed motorized water ski (10) by the rider (12) from the stern (20);

an intake grate (148) formed in the hull bottom (58);

a hull bottom section forward of the intake grate (148) that blends smoothly into the second "V" shaped portion (195A, 195B) and connects to the rails (190A, 190B) to minimize aeration of water entering the pump (100);

a pair of hydrosteps (183A, 183B) aft of the intake grate (148) that assist in the efficient release of water as the hull (16) transitions to a hydroplane mode, thus providing stability and decreased water resistance to the hull (16); and the motor (108) and pump (100) being mounted within the hull (16) such that the high speed motorized water ski (10) has a riderless center of gravity (121) that is within an envelope located beneath the deck (22) and aft of the motor (108), enabling the rider (12) located on the deck (22) to be in an essentially neutral position with respect to the net center of gravity (120) of the high speed motorized water ski (10) plus rider (12), thus allowing the rider (12) to maneuver and turn the high speed motorized water ski (10), without the use of a mechanical turning device, by a shift in his stance or weight distribution on the deck. (22) that moves the net center of gravity (120) of the high speed motorized water ski (10) and the rider (12), thus turning the high speed motorized water ski (10) about an approximately vertical axis of rotation that is approximately coincident with the location of the rider (12) to facilitate maintenance of balance and stability of the rider (12) while riding the high speed motorized water ski (10) and while turning it about an approximately vertical axis.

2. The high speed motorized water ski (10) according to claim 1 wherein the second "V" shaped portion (195A, 195B) on either side of the hydrosteps (183A, 183B) provide the rider (12) with leverage to facilitate transitioning of the high speed motorized water ski (10) from straight line cruising to turning modes.

3. A motorized water ski (10) that has stability and maneuverability for a rear mounted rider (12), comprising:

a hull (16) having a bow (18), a stern (20), a deck (22) sized for accommodating the rider (12) in a standing position, a hydroplane surface (180) formed on the hull (16) and a longitudinal axis (144) extending from the bow (18) to the stern (20);

a pair of curved side rails (190A and 190B) formed on opposite sides of the hull (16);

a hull bottom (58) having a first "V"-shaped portion (194A, 194B) forward of the widest beam portion (182A, 182B ) of the hull (16) the "V" shaped portion (194A, 194B) transitioning aft along the hull bottom 58 to a second "V" shaped portion (195A 195B) between the hydroplane surface (180) and the curved side rails (190A, 190B) the second "V"-shaped portion (195A and 195B), the curved side rails (190A, 190B) cooperating with the rider's movement of the net center of gravity (120) to enable smooth transition from startup to high speed planing and easy initiation and execution of high and low speed turns;

a pump (100) fixedly mounted in the stern (20) for discharging a propelling stream of water outwardly from the stern (20) in a direction fixed to be generally parallel with the longitudinal axis (144) of the motorized water ski (10);

a motor (108) disposed within the hull (16) for driving the pump (100), the motor (108) being mounted in the hull (16) forward of the deck (22), thus enabling easy deep water mounting of the motorized water ski (10) by the rider (12) from the stern (20);

a hull bottom section that blends smoothly into the second "V" shaped portion (195A, 195B) and connects to the rails (190A, 190B) to minimize aeration of water entering the pump (100);

a pair of hydrosteps (183A, 183B) that define edges of the hydroplane surface (180) which assist in the efficient release of water as the hull (16) transitions to a hydroplane mode, thus providing increased stability and decreased water resistance to the hull (16); and the motor (108) and pump (100) being mounted within the hull (16) such that the motorized water ski (10) has a riderless center of gravity (121) that is within an envelope located beneath the deck (22) and aft of the motor (108), enabling the rider (12) located on the deck (22) to be in an essentially neutral position with respect to the center of gravity (121), thus allowing the rider (12) to maneuver and turn the motorized water ski (10), without the use of a mechanical turning device, by a shift in his stance or weight distribution on the deck (22) that moves the net center of gravity (120) of the motorized water ski (10) and the rider (12).

4. A motorized water ski (10) that has stability and maneuverability for a rear mounted rider (12), comprising:

a hull (16) having a bow (18), a stern (20), a deck (22) sized for accommodating the rider (12) in a standing position, a hydroplane surface (180) formed on the hull (16) and a longitudinal axis (144) extending from the bow (18) to the stern (20);

a pair of curved side rails (190A and 190B) formed on opposite sides of the hull (16);

a hull bottom (58) having a first "V"-shaped portion (194A, 194B) forward of the widest beam portion (182A, 182B) of the hull (16) the "V" shaped portion (194A, 194B) transitioning aft along the hull bottom 58 to a second "V" shaped portion (195A 195B) between the hydroplane surface (180) and the curved side rails (190A, 190B) the second "V"-shaped portion (195A and 195B), the curved side rails (190A, 190B) cooperating with the rider's movement of the net center of gravity (120) to enable smooth transition from startup to high speed planing and easy initiation and execution of high and low speed turns;

a pump (100) fixedly mounted in the stern (20) for discharging a propelling stream of water outwardly from the stern (20) in a direction fixed to be generally parallel with the longitudinal axis (144) of the motorized water ski (10);

a motor (108) disposed within the hull (16) for driving the pump (100), the motor (108) being mounted in the hull (16) forward of the deck (22), thus enabling easy deep water mounting of the motorized water ski (10) by the rider (12) from the stern (20);

a hull bottom section that blends smoothly into the second "V" shaped portion (195A, 195B) and connects to the rails (190A, 190B) to minimize aeration of water entering the pump (100);

a pair of hydrosteps (183A, 183B) that define edges of the hydroplane surface (180) which assist in the efficient release of water as the hull (16) transitions to a hydroplane mode, thus providing increased stability and decreased water resistance to the hull (16); and the motor (108) and pump (100) being mounted within the hull (16) such that the motorized water ski (10) has a riderless center of gravity (121) that is within an envelope located beneath the deck (22) and aft the motor (108), enabling the rider (12) located on the deck (22) to be in an essentially neutral position with respect to the center of gravity (121), thus allowing the rider (12) to maneuver and turn the motorized water ski (10), without the use of a mechanical turning device, by a shift in his stance or weight distribution on the deck (22) that moves the net center of gravity (120) of the motorized water ski (10) and the rider (12) laterally with respect to the longitudinal axis (144) and causing one of the side rails to interact with the water and thus turn the motorized water ski.

* * * * *